US009539519B2

(12) United States Patent
Vollers et al.

(10) Patent No.: US 9,539,519 B2
(45) Date of Patent: Jan. 10, 2017

(54) LID SHAPED AS A BUILDING BLOCK, USE THEREOF AND METHOD FOR PRODUCING THE SAME

(71) Applicant: Vilma da Silva Araujo Baptista, Rio de Janeiro (BR)

(72) Inventors: Claudio Patrick Vollers, Rio de Janeiro (BR); Henry Jun Suzuki, São Paulo (BR)

(73) Assignee: Vilma da Silva Araujo Baptista, Rio de Janeiro (BR)

( * ) Notice: Subject to any disclaimer, the term of this patent is extended or adjusted under 35 U.S.C. 154(b) by 0 days.

(21) Appl. No.: 14/758,264

(22) PCT Filed: Dec. 26, 2013

(86) PCT No.: PCT/BR2013/000599

§ 371 (c)(1),
(2) Date: Jun. 29, 2015

(87) PCT Pub. No.: WO2014/100875

PCT Pub. Date: Jul. 3, 2014

(65) Prior Publication Data

US 2015/0336019 A1 Nov. 26, 2015

(30) Foreign Application Priority Data

Dec. 28, 2012 (BR) ..... 102012033635-9

(51) Int. Cl.
*A63H 33/08* (2006.01)
*B65D 43/02* (2006.01)
(Continued)

(52) U.S. Cl.
CPC ..... *A63H 33/08* (2013.01); *B65D 41/00* (2013.01); *B65D 43/0202* (2013.01); *B65D 81/361* (2013.01); *B65D 81/365* (2013.01)

(58) Field of Classification Search
CPC ..... A63H 33/04; A63H 33/08; B65D 81/365
See application file for complete search history.

(56) References Cited

U.S. PATENT DOCUMENTS

D87,709 S 9/1932 Brennan
D111,993 S 11/1938 Pollak
(Continued)

FOREIGN PATENT DOCUMENTS

AU WO 0205918 A1 * 1/2002 ..... A63H 33/04
BR 7002428 U 2/1991
(Continued)

OTHER PUBLICATIONS

European Search Report dated Sep. 7, 2016, issued in EP Application No. 13 869 236.

*Primary Examiner* — John Ricci
(74) *Attorney, Agent, or Firm* — Carter, DeLuca, Farrell & Schmidt, LLP

(57) ABSTRACT

The disclosure refers to a lid in the form of a building block, including a side wall, top surface with an internal wall and an external wall, the base of the lid, one or more male pins and one or more female openings, with their longitudinal axes placed in a direction that is essentially parallel to the internal section of the side wall provided with a lid fixing element to the package to be closed, in which one or more male pins have an external diameter of (4.8±0.1) millimeters, of (6.5±0.1) millimeters, or of (9.4±0.2) millimeters, and one or more female openings which have an internal diameter of (4.8±0.1) millimeters, of (6.5±0.1) millimeters or of (9.4±0.2) millimeters.

13 Claims, 24 Drawing Sheets

(51) Int. Cl.
*B65D 81/36* (2006.01)
*B65D 41/00* (2006.01)

(56) References Cited

U.S. PATENT DOCUMENTS

| | | | | |
|---|---|---|---|---|
| 3,005,282 | A | 10/1961 | Christiansen | |
| 3,487,579 | A | 1/1970 | Brettingen | |
| 3,570,170 | A | 3/1971 | Kishi | |
| 3,597,875 | A * | 8/1971 | Christiansen | A63H 33/086 446/128 |
| 3,713,247 | A | 1/1973 | Parrilla | |
| 4,141,461 | A | 2/1979 | LaChance | |
| 4,202,456 | A | 5/1980 | Silber | |
| 4,964,833 | A * | 10/1990 | Suzuki | A63H 33/086 446/118 |
| 5,361,919 | A | 11/1994 | Hull et al. | |
| 5,435,769 | A | 7/1995 | Bertrand | |
| 5,653,621 | A | 8/1997 | Yao | |
| 5,795,210 | A | 8/1998 | Kushner et al. | |
| D397,938 | S | 9/1998 | Graham et al. | |
| 6,029,974 | A | 2/2000 | Povitz et al. | |
| 6,050,044 | A * | 4/2000 | McIntosh | A63H 33/086 446/124 |
| 6,086,444 | A | 7/2000 | Glickman | |
| 6,296,541 | B1 | 10/2001 | Bezalel et al. | |
| D469,693 | S | 2/2003 | Weiss et al. | |
| 6,554,676 | B1 | 4/2003 | Bach | |
| 6,616,499 | B1 | 9/2003 | Sorensen | |
| 6,640,988 | B2 * | 11/2003 | Taha | B29C 45/262 215/252 |
| 6,645,033 | B1 | 11/2003 | Thomsen | |
| 6,702,642 | B1 * | 3/2004 | Parein | A63H 33/08 446/105 |
| 6,739,935 | B2 | 5/2004 | Van Teunenbroek et al. | |
| 7,374,053 | B2 | 5/2008 | Herald et al. | |
| 7,644,828 | B1 | 1/2010 | Klein | |
| 7,708,615 | B2 | 5/2010 | Munch | |
| 8,105,128 | B1 | 1/2012 | Sorensen et al. | |
| 8,187,050 | B1 | 5/2012 | Sorensen | |
| 8,360,257 | B2 | 1/2013 | Sebille et al. | |
| D683,625 | S | 6/2013 | Miranda De Araujo et al. | |
| D689,558 | S | 9/2013 | Jensen | |
| 8,695,820 | B2 | 4/2014 | Rabie | |
| 8,697,806 | B2 | 4/2014 | Michie, Jr. et al. | |
| 9,016,473 | B2 | 4/2015 | Tamarindo | |
| D748,980 | S | 2/2016 | Vollers et al. | |
| D748,981 | S | 2/2016 | Vollers et al. | |
| 2003/0234488 | A1 | 12/2003 | Povitz | |
| 2008/0311819 | A1 | 12/2008 | Andersen | |
| 2010/0102020 | A1 | 4/2010 | Sebille et al. | |
| 2010/0185323 | A1 | 7/2010 | Moor et al. | |
| 2011/0139745 | A1 | 6/2011 | Ezra et al. | |
| 2013/0090033 | A1 * | 4/2013 | Vollers | A63H 33/086 446/71 |
| 2013/0252504 | A1 | 9/2013 | Chang et al. | |
| 2014/0051321 | A1 | 2/2014 | Kelly et al. | |
| 2014/0227937 | A1 | 8/2014 | Pai-Chen | |
| 2014/0256211 | A1 | 9/2014 | Cheng | |

FOREIGN PATENT DOCUMENTS

| | | | | |
|---|---|---|---|---|
| BR | 7002429 | U | 2/1991 | |
| BR | 7002250 | U | 5/1992 | |
| BR | 7002421 | U | 7/1992 | |
| BR | 7002422 | U | 7/1992 | |
| BR | 7002423 | U | 7/1992 | |
| BR | 7002424 | U | 7/1992 | |
| BR | 7002425 | U | 7/1992 | |
| BR | 7002426 | U | 7/1992 | |
| BR | 7002427 | U | 7/1992 | |
| BR | 7002430 | U | 7/1992 | |
| BR | PI0000140 | | 10/2001 | |
| BR | 9802607 | A | 6/2005 | |
| BR | PI0802245 | A2 | 9/2009 | |
| BR | 302013004810 | | 9/2013 | |
| BR | 302013004811 | | 9/2013 | |
| BR | 302013004812 | | 9/2013 | |
| BR | 102012033635 | | 8/2014 | |
| CN | 2271503 | Y | 12/1997 | |
| CN | 2571697 | Y | 9/2003 | |
| CN | 2706417 | Y | 6/2005 | |
| CN | 202046587 | U | 11/2011 | |
| CN | 201230100649 | | 9/2012 | |
| CN | 201230100653 | | 5/2013 | |
| CN | 201230375545 | | 5/2013 | |
| CN | 201230375582 | | 5/2013 | |
| CN | 201230375583 | | 5/2013 | |
| CN | 201230375807 | | 5/2013 | |
| CN | 201230376001 | | 5/2013 | |
| DE | 2242046 | A1 * | 2/1974 | A63H 33/086 |
| DE | 8003690 | U1 | 5/1980 | |
| DE | 19730248 | A1 | 1/1999 | |
| EP | 2489605 | A1 | 8/2012 | |
| FR | 2336956 | A1 | 7/1977 | |
| GB | 2410493 | A | 8/2005 | |
| IL | 41948 | A | 1/1977 | |
| JP | H09187580 | | 7/1997 | |
| KR | 20120007912 | U | 11/2012 | |
| RU | 106605 | U1 | 7/2011 | |
| RU | 108024 | U1 | 9/2011 | |
| WO | 9936332 | A1 | 7/1999 | |
| WO | 9948582 | A1 | 9/1999 | |
| WO | 99/67151 | A1 | 12/1999 | |
| WO | 0013983 | A1 | 3/2000 | |
| WO | 0055063 | A1 | 9/2000 | |
| WO | D053490-002 | | 9/2000 | |
| WO | D053490-003 | | 9/2000 | |
| WO | D053490-004 | | 9/2000 | |
| WO | 0168210 | A2 | 9/2001 | |
| WO | 0205918 | A1 | 1/2002 | |
| WO | 2007110301 | A2 | 10/2007 | |
| WO | 2010023652 | A1 | 3/2010 | |
| WO | 2011153598 | A1 | 12/2011 | |
| WO | 2014100875 | A1 | 7/2014 | |
| WO | 2014100876 | A1 | 7/2014 | |
| WO | 2015039201 | A1 | 3/2015 | |
| WO | 2015039205 | A1 | 3/2015 | |
| WO | 2015058270 | A1 | 4/2015 | |
| WO | 20150117215 | A1 | 8/2015 | |

* cited by examiner

1A

1B

1C

1D

6A

6B

LID SHAPED AS A BUILDING BLOCK, USE THEREOF AND METHOD FOR PRODUCING THE SAME

TECHNICAL FIELD

This disclosure pertains to the field of packaging lids that are in the form of building blocks. More specifically, this disclosure is in relation to certain lids in the shape of building blocks with connections that are compatible with basic connection standards of building blocks sold under the LEGO® and/or LEGO® DUPLO® brands, or other similar compatible brands, as well as their uses and production processes.

BACKGROUND OF THE INVENTION

Packaging lids in the form of building blocks are known and have been described in several patent publications: EP2489605, WO2011153598, CN202046587U, RU106605, RU108024, WO201023652, U.S. Pat. No. 8,187,050, BR200802245, GB2410493, CN2706417U, CN2571697U, WO200205918, WO200168210, WO200055063, WO9967151, BR9802607, WO9948582, WO9936332, U.S. Pat. No. 5,361,919, DE8003690, U.S. Pat. No. 4,202,456, IL41948, U.S. Pat. No. 3,713,247.

They have also been described in various industrial designs: BR-DI7002250-0, BR-DI7002421-9, BR-DI7002422-7, BR-DI7002423-5, BR-DI7002424-3, BR-DI7002425-1, BR-DI7002426-0, BR-DI7002427-8, BR-DI7002428-6, BR-DI7002429-4, BR-DI7002430-8, BR-DI7003736-1, BR-DI7003737-0, BR-DI7003738-8, BR-DI7003739-6, BR-DI7003740-0, BR-DI7003741-8, BR-DI7003742-6, BR-DI7003743-4, BR-DI7003744-2, BR-DI7003745-0, BR-DI7003746-9, BR-DI7003747-7, BR-DI7005906-3, BR-DI7005907-1, BR-DI7005908-0, BR-DI7005909-8, BR-DI7005910-1, BR-DI7005911-0, BR-DI7005912-8, BR-DI7005913-6, BR-DI7005914-4, BR-DI7005915-2, BR-DI7005916-0, BR-DI7005917-9, BR-DI7005918-7, BR-DI7005919-5, BR-DI7005920-9, BR-DI7005921-7, BR-DI7005922-5, BR-DI7005923-3, BR-DI7005924-1, BR-DI7005925-0, BR-DI7102727-0, BR-DI7102833-1, CN-201230100653.9, WO-D053490-002, WO-D053490-003 and WO-D053490-004.

Although they have several ways of fitting together, the problem with the lids that are the current state-of-the-art is their lack of versatility in assembly and compatibility with building block-type toys that already exist, especially with building block-type toys under the LEGO®, LEGO® DUPLO® brands, or other similar compatible brands.

Building block-type toys sold under the LEGO® and LEGO® DUPLO® brands are probably the most widely distributed internationally. Their success may be at least partially attributed to the standards regarding sizes, shape and spatial distribution of the basic connections. More recently, success has also been due to the large number of electromechanical accessories, people, moving parts, and special shapes.

This disclosure solves problems in the current state-of-the-art by making lids of building blocks compatible with building block-type toys in the LEGO® and/or LEGO® DUPLO® lines, and vice versa. At the same time, it allows assembly of varied sets comprised of just lids. In optional complementary features, this disclosure also provides building block-type lids that are compatible with building blocks of the LEGO® and/or LEGO® DUPLO® lines that minimize undesired connection problems between lids, for example, when they are stacked linearly in certain package-closing machines. It also has optional building block-type lids that are compatible with building blocks from the LEGO® and/or LEGO® DUPLO® lines that bypass potential connection impossibility problems that could occur due to the mismatch of constitutive elements of two or more lids to be fitted together.

BRIEF DESCRIPTION OF THE FIGURES

FIG. 7A shows an example of a tubular female opening (5), with a squared cross section that is completely comprised of elements in the lid internal section.

FIG. 7B shows an example of four female openings (5) formed by vanes on the lid internal section and by vanes on the lid external section.

FIG. 7C shows an example of four tubular female openings (5), with a circular cross section that is completely comprised of elements in the lid external section FIG. 7D shows an example of six tubular female openings (5) with a circular section, with four of them comprised by elements on the lid external section, and two of them comprised by elements in the lid internal section.

FIG. 12 shows examples of optional breakage seals (8) for the lids, while FIG. 12E shows an example in which the base of the lid (3) has small indentations and the appearance of the junction formed by the side wall (1), the base of the lid (3) and the rupture seal (8) is of small windows at the level of the base of the lid (3).

FIG. 13 shows different distributions of positioning and optional configurations for male pins (4), female openings (5) and the base of the lid (3).

FIGS. 14A, 14B, 14C and 14D show examples of connections in diagonal stacks, respectively, of lids shown in FIGS. 13A, 13B, 13C and 13D.

At FIGS. 1 to 17, the representation of one or more constitutive elements of the lids may have been suppressed, so that the other elements would become more evident. Such suppression is commonly observed for the lid fixing element to the package to be closed (14), which does not appear in many of the inferior perspective views, although it is present in all lids according to this disclosure. At FIG. 11, the package to be closed is marked as "PK".

Figure 18:
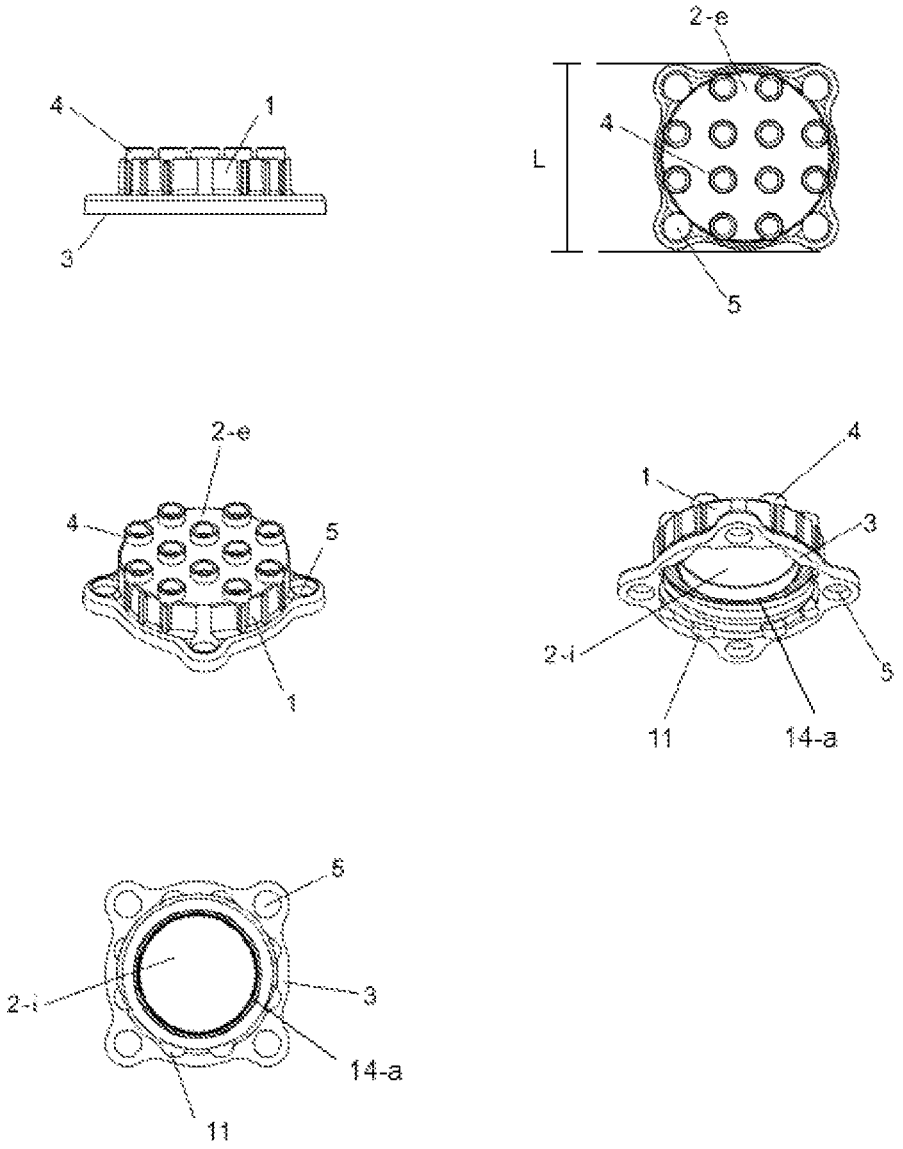

FIG. 18 shows example of lid according to this disclosure, with dimensions compatible with bottle necks Finish PCO1881, with twelve male openings [sic] (4) on the top surface (2-*e*) and four female openings (5) next to the vase of the lid (3), in which the base of the lid (3) and the female (5) present an enlargement ring around them. Such ring has quadrangular format, which inscribes into a square with lateral dimension (L) of (31.8±0.2) millimeters.

FIGS. 19A to 19F and 20A to 20C show additional examples of lids according to this disclosure.

DETAILED DESCRIPTION

According to a first principal feature, this disclosure consists of a functional lid in the form of a building block, including a side wall (1) provided with a lid fixing element to the package to be closed (14), for example, a screw (14*a*), top surface (2) with an internal wall (2-*i*) and an external wall (2-*e*), the base of the lid (3), one or more male pins (4) and one or more female openings (5), with their longitudinal axes placed in a direction that is essentially parallel to the internal section of the side wall (1), in which one or more male pins (4) have an external diameter (ED) of (4.8±0.1) millimeters, of (6.5±0.1) millimeters, or of (9.4±0.2) millimeters, and one or more female openings (5) have an internal diameter (ID) of (4.8±0.1) millimeters, of (6.5±0.1) millimeters or of (9.4±0.2) millimeters.

Figure 1:
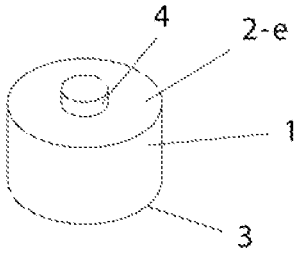
FIG. 1 shows a drawing of the components of the lids included by this disclosure, including a side wall (1) provided with a lid fixing element to the package to be closed (14), for example, a screw (14*a*), top surface (2) with an internal wall (2-*i*) and an external wall (2-*e*), base of the lid (3), male pin (4) and female opening (5). 1A is seen from above, 1B is seen from above, 1C is seen from below, and 1D is from below.
Figure 1:
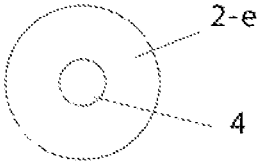
Figure 1:
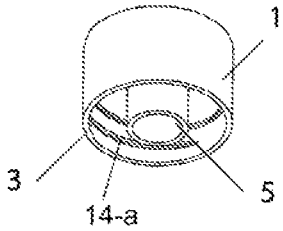
Figure 1:
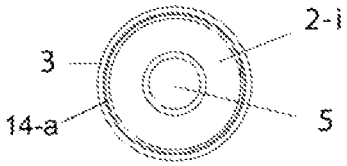

Examples of constitutive elements of the lids included by this disclosure are shown in FIG. 1.

According to this disclosure, a functional lid is understood to be any lid whose function is to close packages, provided with lid fixing elements to the package to be closed, such as screws or locks for attaching, removing, and possibly replacing them. The use of lids according to this disclosure is not limited, but it may be particularly useful to close soda, water, and juice bottles, etc., in which the opening is a relatively uniform standard among products of different brands found in the market. Other types of packaging in which the lids included by this disclosure may be useful involve, for example, jars for food, cosmetics, medications or even containers or tubes for lotions and moisturizing creams, among other things.

Also in accordance with this disclosure, building blocks are understood to be unitary structures with protuberances and indentations that can be connected with other compatible unitary structures, forming three-dimensional sets that are relatively stable and that can be lifted and turned upside down without the unitary structures coming loose from each other.

As per this disclosure, a side wall (1) is understood to be the section of the lid that remains laterally and directly in contact with the package to be closed. Lid fixing element to the package to be closed (14) is understood as a lateral wall (1) constitutive element with the function of keeping the lid firmly attached to the package to be closed. Top surface (2) is understood to be the section of the lid that joins to the side wall (1) in order to close the package, and the base of the lid (3) is understood to be the lower edge of the side wall (1) that is opposite the top surface (2).

In optional configurations, the side wall (1) may be cylindrical or it may have other shapes.

Examples of examples of lid fixing elements to the package to be closed (14) are shown at FIGS. 17A to 17C, and include: screw (14-*a*), "pull and turn" type lock (14-*b*), deformable ring type lock (14-*c*). Fixing elements in shape of screw (14-*a*) are presented in form of grooves or protuberances helicoid shaped, continuous or segmented, and are particularly useful to close packages with bottle necks with complementary helicoid shaped protuberances or grooves, analog to nut and bolt. Fixing elements in shape of "pull and turn" type lock (14-*b*) are presented in form of protuberances in the lid which can be inserted and then accommodated, by means of the lid rotation, into letter "L" shaped grooves or ditches in the package to be closed. In an optional construction, they are presented in form of into letter "L" shaped grooves or ditches in the lid into which protuberances in the packaging can be inserted and then accommodated, by means of the lid rotation. Fixing elements in shape of deformable ring type lock (14-*c*) are presented in form of ring, continuous or segmented, in the lid, that expands and then compress around the bottle neck of the package to be closed, commonly provided with a protuberance. In an optional construction it is presented in form of compressible ring or a set composed by multiple flips, in the lid, which compress and then expands around the bottle neck of the packaging to be closed, commonly provided with a groove or depression.

In optional configurations, the top surface (2) may have essentially flat surfaces on both of its external (2-*e*) and internal (2-*i*) walls. Also optionally, the internal wall (2-*i*) of the top surface (2) may be associated with elements that help close the package, such as closing rings, closing membranes, corks or stoppers. In the cases in which the top surface (2) has a cork or a stopper, the wall of the cork or stopper that remains in contact with the package may play the role of the internal portion of the side wall (1). Also optionally, the top surface may be comprised of or covered by overlaid layers. In this case, the wall that remains exposed from the outside of the lid will be considered the external wall of the top surface (2-*e*), and the wall that is exposed from inside the lid will be considered the internal wall of the top surface (2-*i*).

In optional configurations, the base of the lid (3) is presented in the form of aligned elements that essentially delimit the perimeter of a semi-flat section that is parallel to the top surface (2).

Interesting optional constructions for the base of the lid (3) include, for example, the presence of small recesses in relation to the height of the connecting elements located under the internal wall of the top surface (2-*i*), in order to allow the lids as per this disclosure to be able to be seated on a surface that has protuberances or pins that match up with the base of the lid (3), such as, for example, when two lids, as per this disclosure, are placed one on top of the other and the positioning of one of the connecting elements of one of the lids matches up with the base of the lid (3) of the other lid. In optional configurations, the recesses at the base of the lid (3) may be in the form of indentations (9), inward curves (10) or narrowings (11) or their combinations, in the side wall (1). Optional shapes for the recesses may be of many varieties, including, for example, internal portions of prisms, parallelepipeds, cylinders or their portions. In another optional configuration, the recesses on the base of the lid (3) may be applied along its entire length, ensuring that the entire base of the lid is recessed so that the connecting elements, located under the top surface of the internal wall (2-*i*) end up projecting beyond the base of the lid (3).

Figure 2:
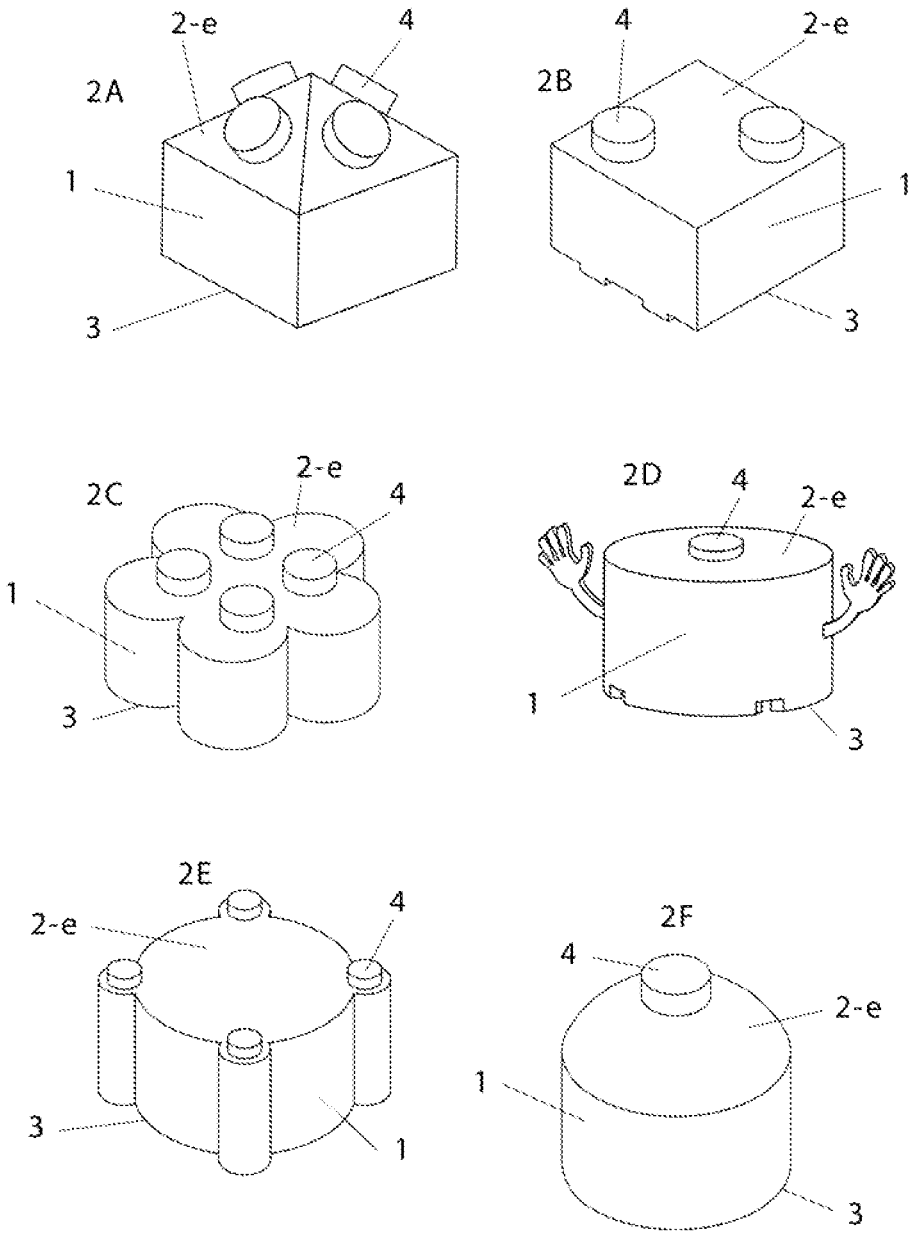
FIG. 2 shows optional configurations for the side wall (1) and for the top surface (2); more specifically, for its external wall (2-*e*), base of the lid (3) and male pin (4). In all cases the view is from an overhead perspective.
Figure 16A:
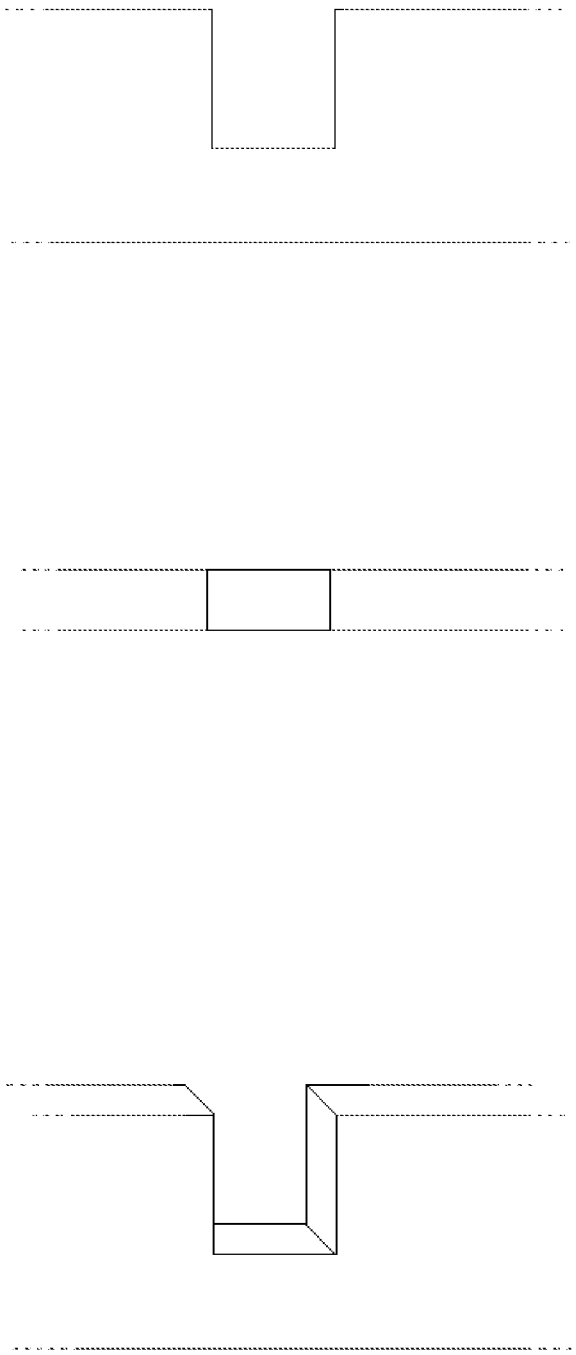
FIGS. 16A to 16C show optional configurations for base of the lid portion with recess in shape of indentation (9) in optional parallelepiped format (FIG. 16A), recess in form of inward curve (10) in optional cylindrical format (FIG. 16B) and recess in shape of narrowing (11) in optional cylindrical format (FIG. 16C), in front view perpendicular to the wall, in vertical view parallel to the wall and in front perspective view.
Figure 16B:
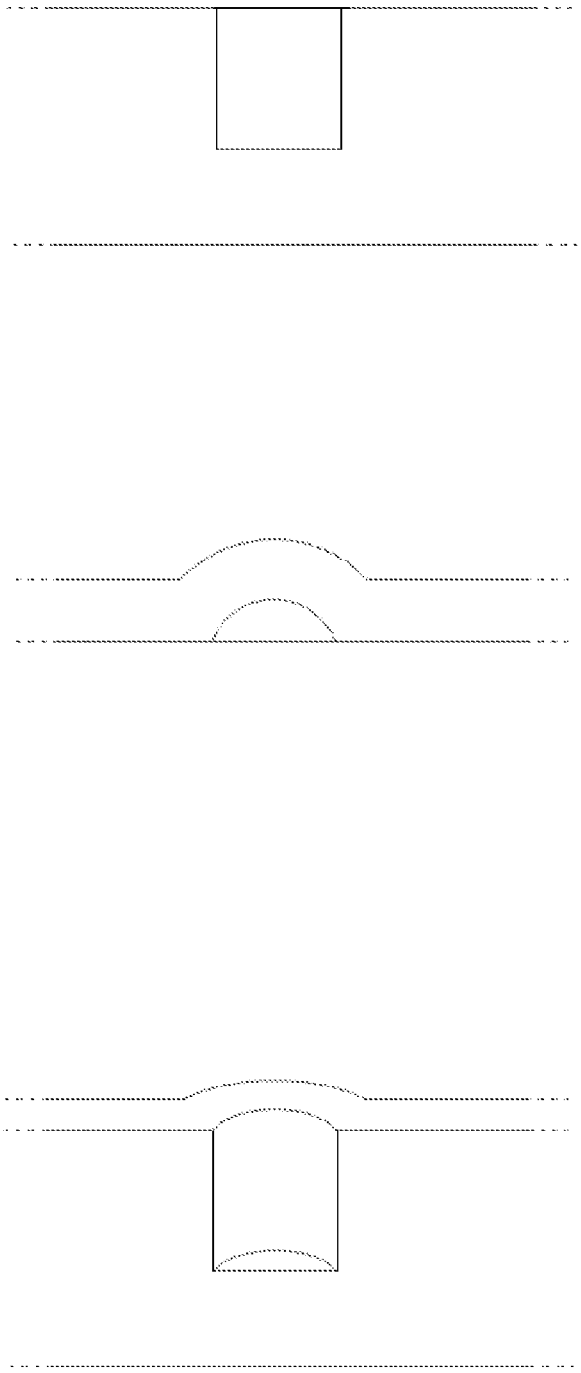
Figure 16C:
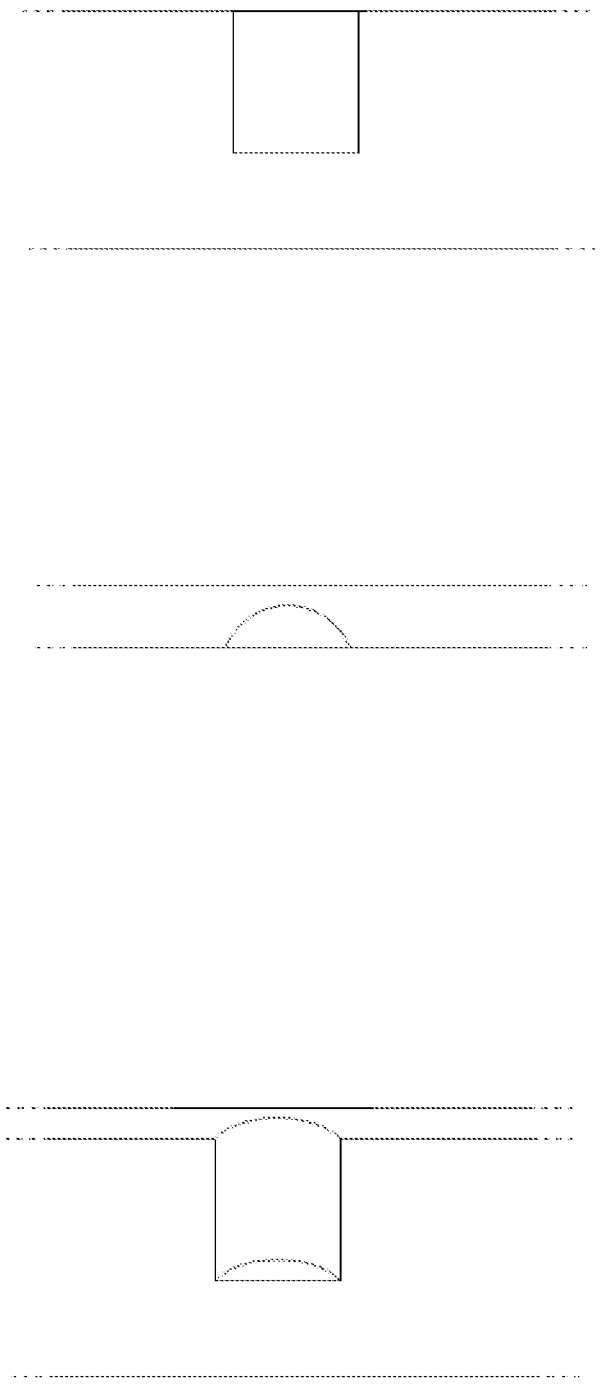
Figure 17:
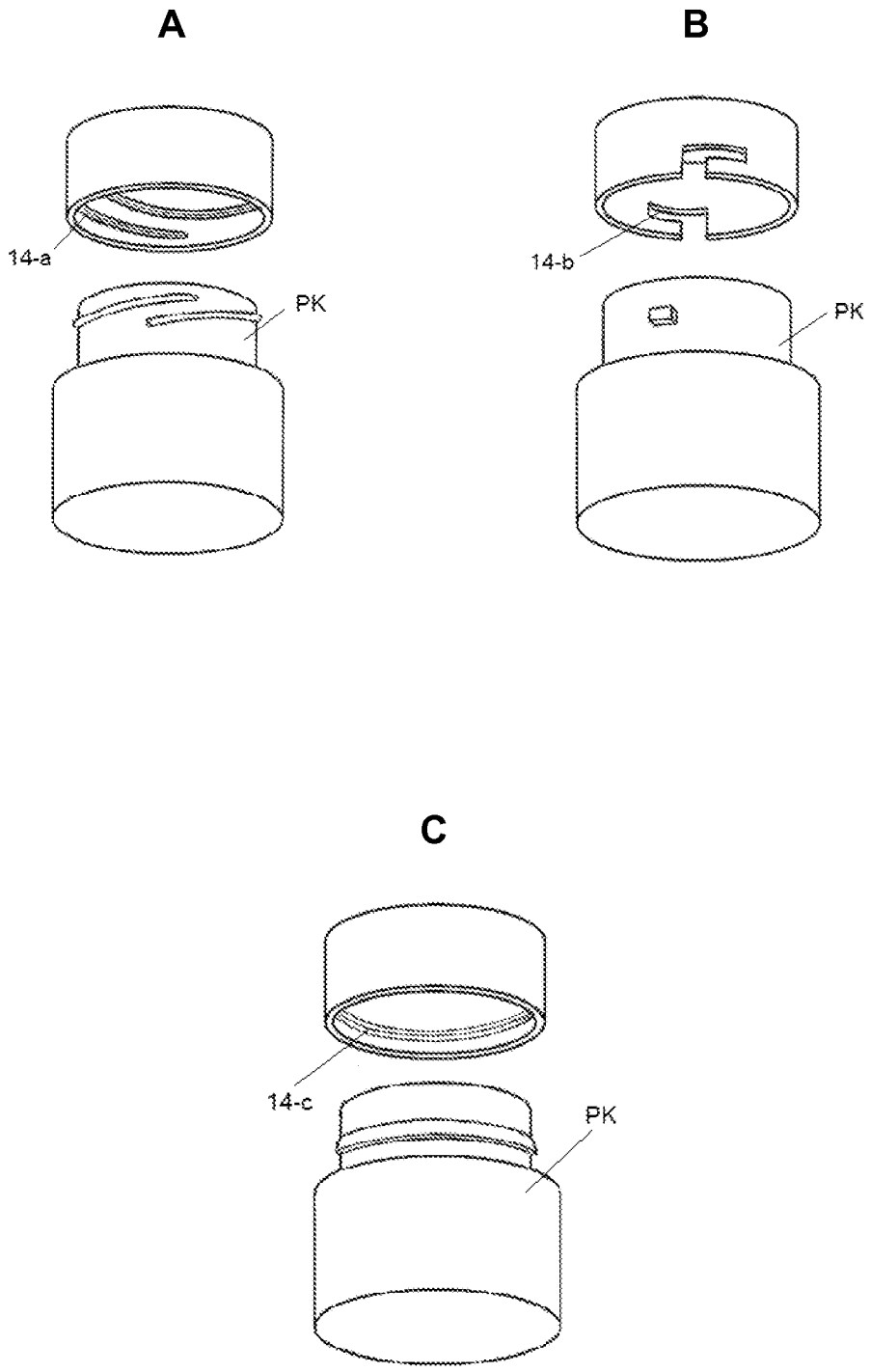
FIGS. 17A to 17C show examples of lid fixing elements to the package to be closed (14), such as screw (14-*a*), (FIG. 17A), "pull and turn" type lock (14-*b*) (FIG. 17B), deformable ring type lock (14-*c*) (FIG. 17C).

Examples of optional configurations for the side wall (1) and for the top surface (2) and the base of the lid (3) are shown in FIG. 2 Examples of recesses in form of indentations (9), inward curves (10) and narrowings (11) at the lateral wall (1) are shown respectively at FIGS. 16A, 16B and 16C.

In one complementary optional construction, the lids included by this disclosure may present an external skirt (6) that consists of a second wall that is external to the side wall (1) and that delimits an empty space or span around it. One example of an optional configuration is that in which the external skirt (6) has an opening toward the same side as the base of the lid (3). Another example of an optional configuration, whether or not it is complementary, is that in which the base of the external skirt (6) is parallel to the base of the lid (3), and it may be on the same plane, or above or below it.

Figure 3:
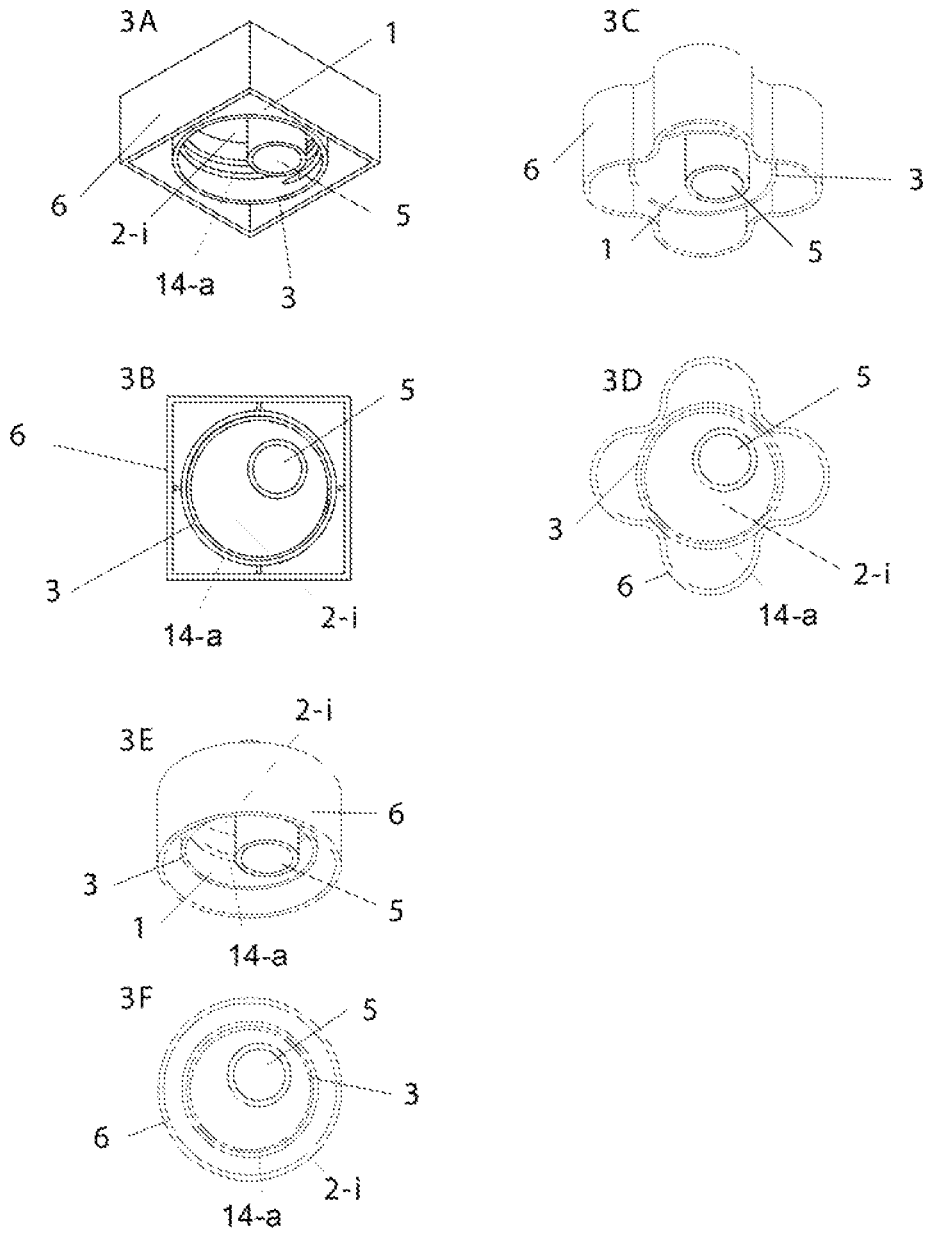
FIG. 3 shows optional configurations for the external skirt (6). 3A, 3C and 3E are from below. 3B, 3D and 3F are from below, corresponding, respectively, to 3A, 3C and 3E.
Figure 19:
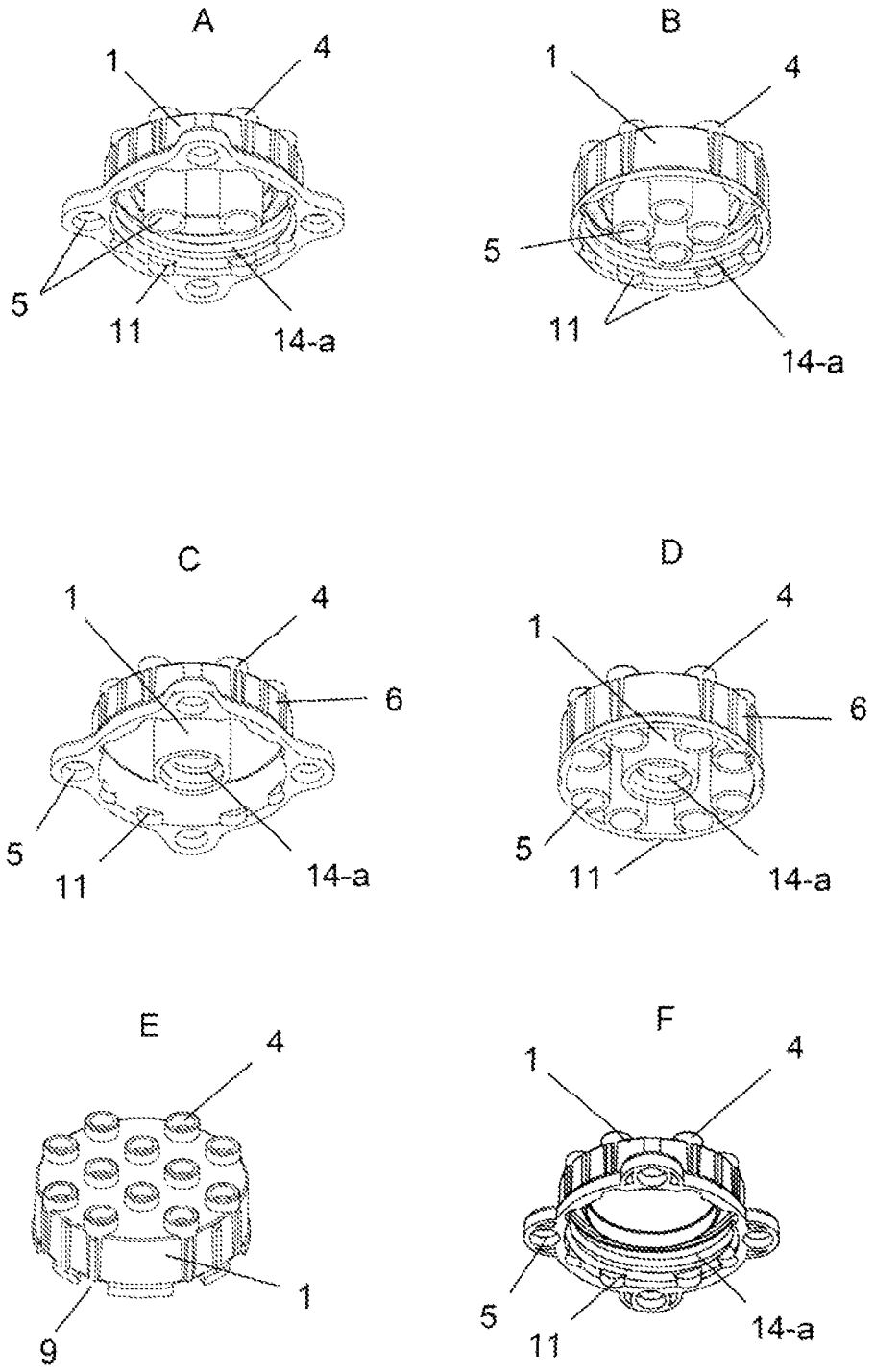
Figure 20:
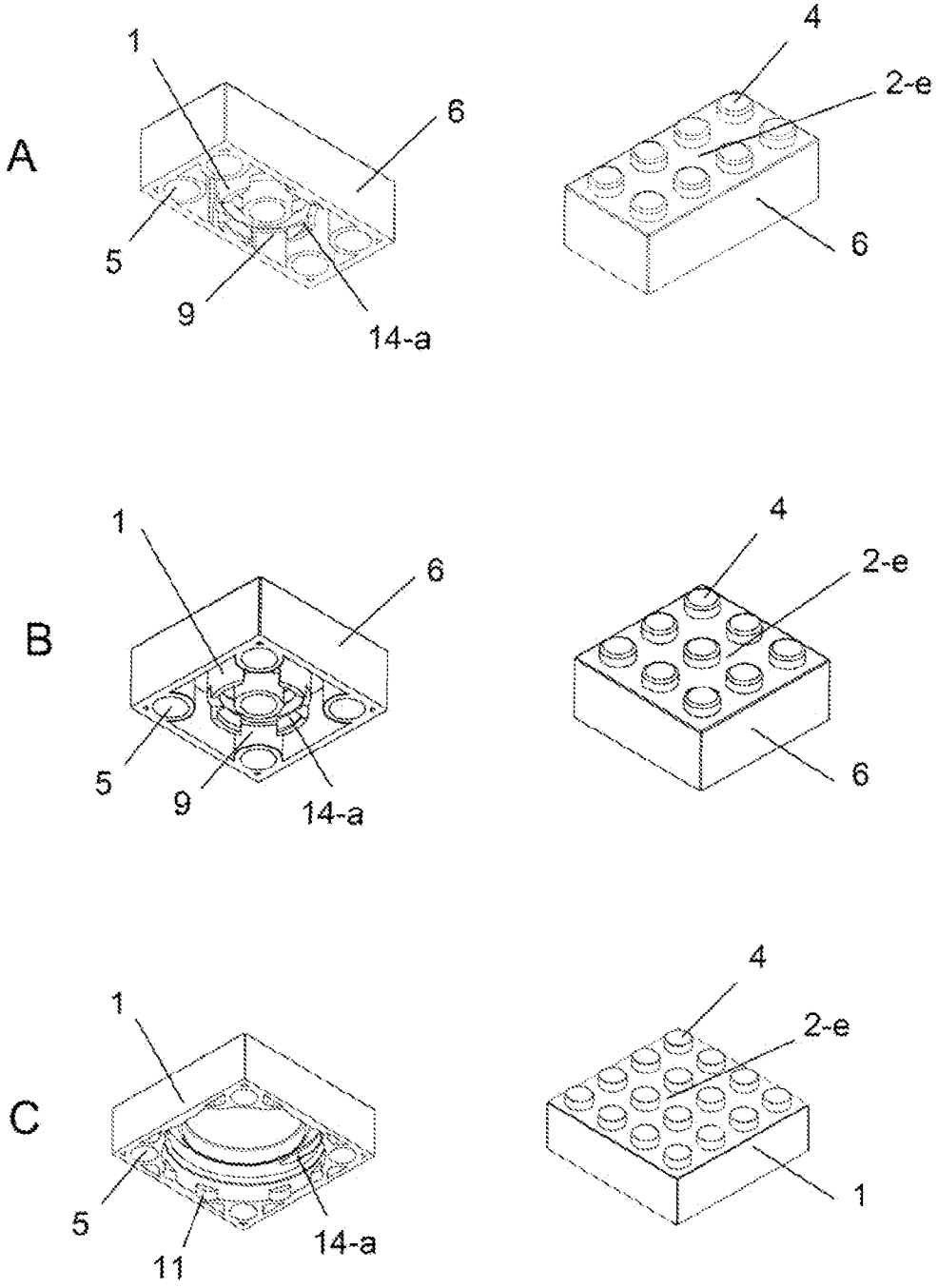

Examples of optional configurations for external skirts (6) are shown in FIG. 3. Optionally, the external skirt (6) may also present recesses in form of indentations (9), inward curves (10) and narrowings (11) at the lateral wall of the external skirt, analogously to recesses at the lateral wall (1). Example of external skirt (6) with recess in form of narrowing is shown in FIGS. 19C and 19D.

As per this disclosure, male pins (4) are understood to be any protuberances that can be connected in cylindrical openings. An example of an optional shape is that in which the male pins (4), as per this disclosure, are essentially cylindrical. Essentially cylindrical shape is understood as an elongated and rectilinear shape, with essentially circular cross-section, with a substantially flat lateral surface or, at most, containing protuberances or protrusions with heights that do not exceed 20% of the diameter of its cross section, especially containing protuberances or protrusions with heights that do not exceed 10% of the diameter of its cross section; these heights measured in the radial direction of the cross section.

Also optionally, the male pins (4) may have different shapes, such as, for example, polygonal prisms, or other shapes. In addition, they may also be formed by sets of separate pieces that together delimit the outside edge of cylinders or polygonal prisms.

Options for interesting formats for male pins (4) include, for example, pins in the shape of cylinders with indentations (12) that allow the lid to be seated and fitted, as per this disclosure, with a second lid that has constitutive elements that would match the positioning of those male pins (4) if they were not indented. The presence of males pins (4) in an indented cylindrical shape may be particularly interesting, for example, in the case of lids in which male pins (4) are present on the outside wall of the top surface (2-*e*) and tubular female openings (5) are present in the internal wall of the top surface (2-*i*), in positions in which the base of the lid (3) would touch one or more male pins (4) if they had completely transversal sections without indentations.

Also in relation to formats, the male pins (4) may have slightly rounded or notched extremities to facilitate their introduction into female openings (5).

According to this disclosure, the external diameter of the male pins (4) is (4.8±0.1), (6.5±0.1) or (9.4±0.2) millimeters. In the case of cylindrical male pins (4) built with materials that are not very malleable, the external diameter (ED) matches the diameter of the external circular section of the pin itself. For male pins (5) with different shapes built using materials that are not very malleable, the external diameter (ED) matches the diameter of the smallest circumference that encircles the cross section of the pin. Male pins (4) built with malleable materials, and whose external diameter (ED) is variable when pressed, will be considered as having a diameter of (4.8±0.1), (6.5±0.1) millimeters or (9.4±0.2) millimeters when they can be inserted, under pressure, into cylindrical orifices with these diameters.

In one possible optional configuration, male pins (4) with (9.4±0.2) millimeters of external diameter (ED) may be combined with female openings (5) with (4.8±0.1) or (6.5±0.1) millimeters of internal diameter (ID), or even male pins (4) with (6.5±0.1) millimeters of external diameter (ED) may be combined with female openings (5) with (4.8±0.1) millimeters of internal diameter (ID), in overhangs in the shape of a tube, in which the internal space of the tube matches the female opening (5) and the external wall of the tube delimits the male pin (4). Other possible optional configurations with a tubular shape include, for example, tubes with an external diameter (ED) of (13.0±0.2) millimeters and internal diameter (ID) of (9.4±0.2), (6.5±0.1) or (4.8±0.1) millimeters.

The male pins (4) may be different lengths; for example, lengths of 1 to 10 millimeters. The use of longer male pins (4) may be particularly interesting when they are built using more malleable materials, such as, for example, polypropylene and polyethylene, or even when the male pins (4) are positioned under the internal wall of the surface of the lid (2). Particularly in the case of longer male pins (4), the use of small cross struts or walls interconnecting the base of two or more male pins (4) may be useful to prevent or minimize their deformation or coming out of alignment with the passage of time.

Figure 4:
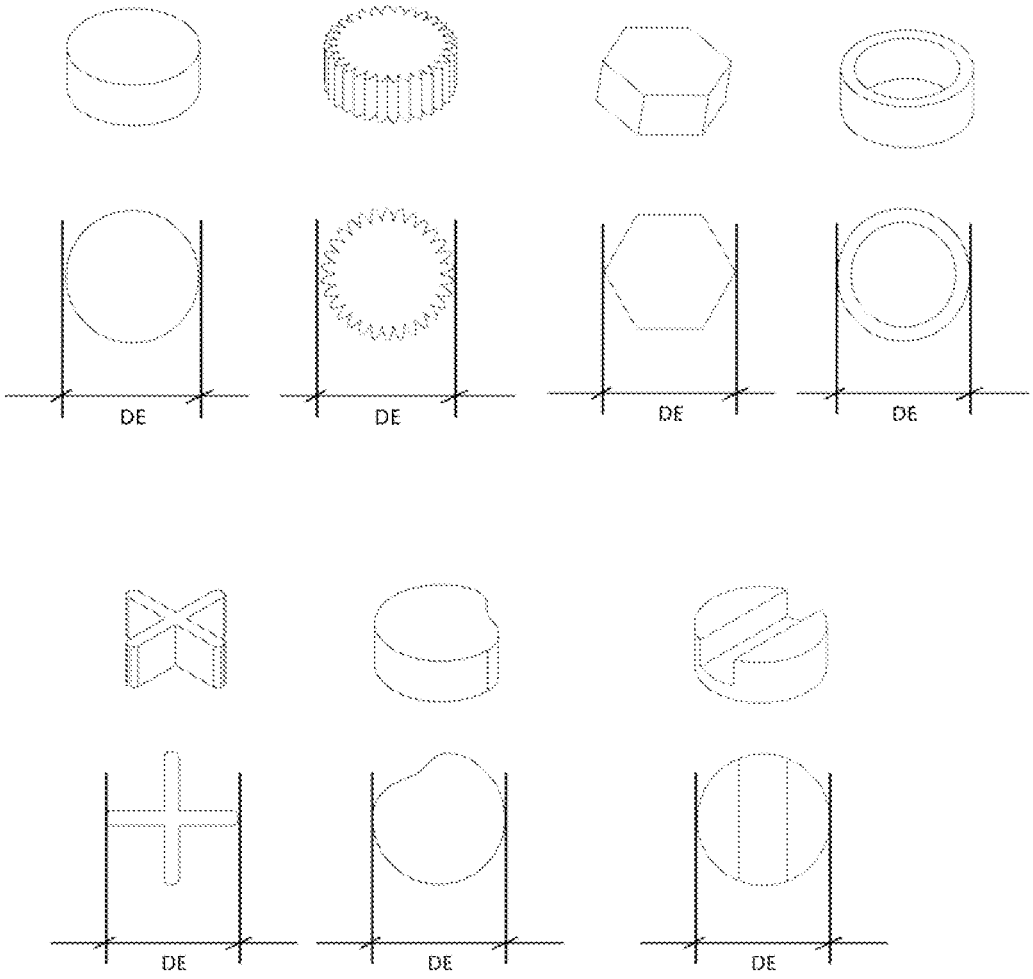
FIG. 4 shows optional configurations for the male pins (4) and shows shapes with which their external diameters (ED) are measured.

Examples of possible configurations of male pins (4) are shown in FIG. 4.

According to this disclosure, female openings (5) are understood to be any indentations into which protuberances from building blocks can be inserted and fitted, such as the male pins (4) described above. The female openings (5), according to this disclosure, may take multiple shapes. Interesting shapes of female openings (5) include those that touch at least three points on cylinders that may be inserted into them.

Options for shapes of female openings (5) include, for example, cylindrical orifices, polygonal prismatic orifices, internal sections of tubular channels, spaces delimited between cylinders or prisms that are essentially parallel, flat surfaces that are essentially parallel, protuberances or vanes placed in a configuration that forms essentially parallel planes, or a combination of these possibilities. Essentially parallel is understood to mean planes or lines with an angle of inclination of up to fifteen degrees between them. In examples of optional configurations, the female openings (5) are delimited by elements that are completely parallel to other.

According to this disclosure, the internal diameter (ID) of the female openings (5) is (4.8±0.1) millimeters, of (6.5±0.1) millimeters, or of (9.4±0.2) millimeters. In the case of cylindrical female openings (5) built with materials that are not very malleable, the internal diameter (ID) matches the diameter of the internal circular section of the opening itself. For female openings (5) in different shapes built using materials that are not very malleable, the internal diameter (ID) matches the diameter of the largest cylinder that can be inserted into the opening. Female openings (5) built with malleable materials, and that have a variable internal diameter (ID) when under pressure, will be considered as having a diameter of (4.8±0.1) millimeters, of (6.5±0.1) millimeters, or of (9.4±0.2) millimeters, while cylinders with those diameters can be inserted into them under pressure.

In one possible optional configuration, female openings (5) with (6.5±0.1) or (4.8±0.1) millimeters of internal diameter (ID) may be combined with male pins (4) with (9.4±0.2) millimeters of external diameter (ED), or female openings (5) with (4.8±0.1) millimeters of internal diameter (ID) may be combined with male pins (4) with (6.5±0.1) millimeters of external diameter (ED) in overhangs in the shape of a tube, in which the internal space of the tube matches the female opening (5) and the external wall of the tube delimits the male pin (4). Other possible optional configurations with a tubular shape include, for example, tubes with an external diameter (ED) of (13.0±0.2) millimeters and internal diameter (ID) of (9.4±0.2), (6.5±0.1) or (4.8±0.1) millimeters.

Figure 5:
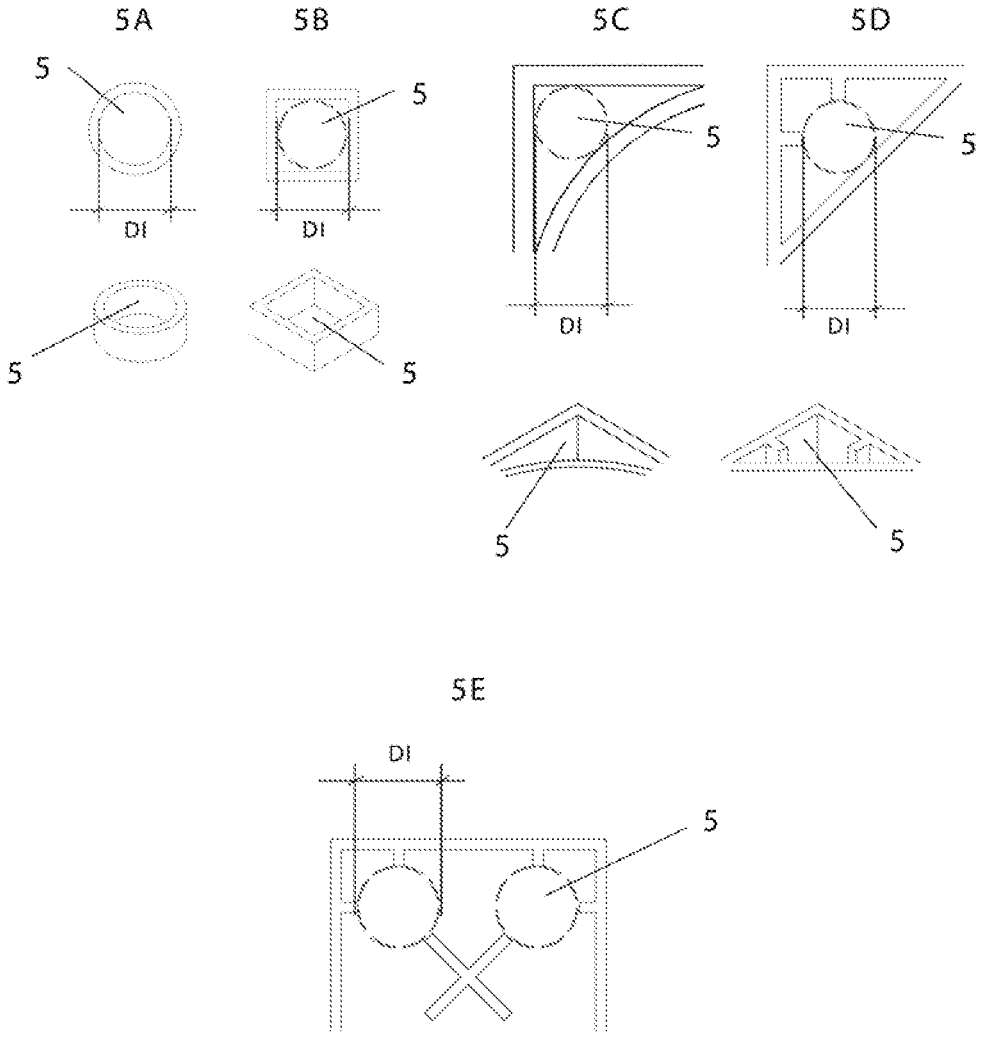
FIG. 5 shows optional configurations for the female openings (5) and shows shapes with which their internal diameters (ID) are measured. In examples 5B, SC, 5D and 5E, using hypothetical dotted lines, the frontal view shows the circumference that matches the internal diameter (ID) of the female openings (5).

Examples of possible optional configurations of female openings (5) are shown in FIG. 5.

An interesting shape for a female opening (5) is that formed by a space delimited by a male opening (4) in the shape of a cylindrical tube (CT), with an external diameter of (6.5±0.1) millimeters and an internal diameter (ID) of (4.8±0.1) millimeters, or with an external diameter of (13.0±0.2) millimeters and an internal diameter (ID) of (9.4±0.2) millimeters, and also delimited by the parallel faces of two vanes (AL) pointed in the direction of the cylindrical tube (CT), in which the apexes of those vanes (AL) and a semi-straight line on the external wall of the cylindrical tube (CT) delimit female openings (5) with internal diameters (ID) of (4.8±0.1) millimeters or of (9.4±0.2) millimeters, respectively.

Figure 6:
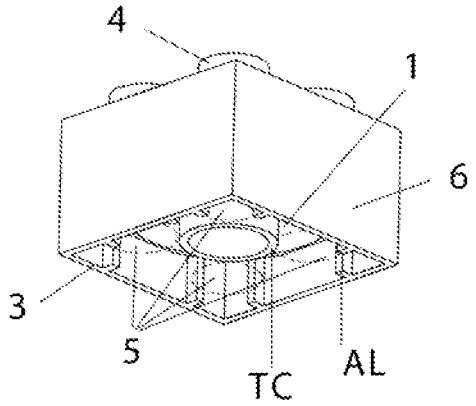
FIG. 6 shows a particular optional configuration for five female openings (5): one central female opening (5) in the shape of the internal portion of a central tube (CT) and four lateral female openings (5) delimited by vanes (AL) on the external skirt (6) and by the external wall of the central tube (CT). 6A is the view from below, and 6B is the view from below. In 6A and 6B, the circumference that matches the internal diameter (ID) of the side female openings (5) is represented by hypothetical dotted lines.
Figure 6:
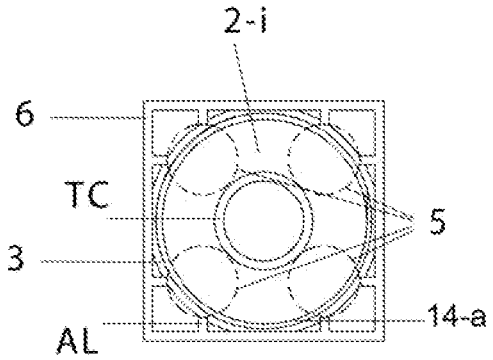

Examples of possible female openings (5) with such a configuration are shown in FIG. 6.

In relation to depth, the female openings (5) may be sized differently; for example, depths of 1 to 10 millimeters. The use of deeper female openings (5) may be particularly interesting when they are combined with longer male pins (4). Particularly in the case of deeper female openings (5), the use of small cross struts or walls interconnecting the external walls of two or more female openings (5) may be interesting to prevent or minimize their deformation or coming out of alignment with the passage of time.

In relation to the location on the lid, the male pins (4) and the female openings (5) may be seated in or connected to any lid components, including the external wall of the top surface (2-*e*) or its extension, the internal wall of the top surface (2-*i*), or the side wall (1) or the optional skirt of the lid (6).

Figure 7:
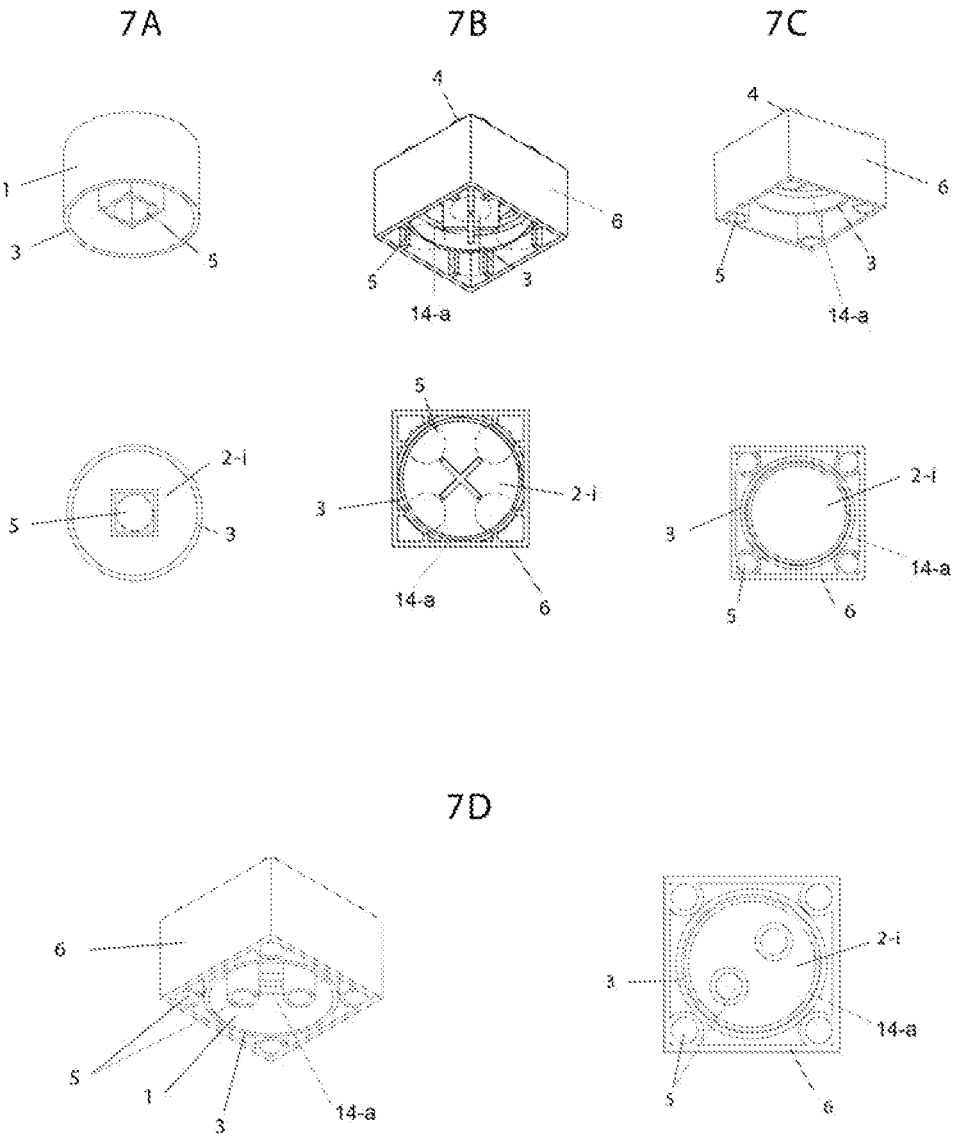
FIG. 7 shows configurations of female openings (5) in relation to their positioning regarding the portion of the lid that comes into contact with the internal part of the package.

According to optional configurations, the elements that form the female openings (5) may be completely laid out on the section of the lid that comes into contact with the internal part of the packaging that is to be closed. According to a second optional configuration, the elements that form the female openings (5) may be partially distributed on the section that comes into contact with the internal part of the package, and partially on the section that does not come into contact with the internal part, such as, for example, the internal wall of the external skirt (6). According to a third optional configuration, the female openings (5) may be completely distributed in the section that does not come into contact with the internal part of the packaging. This third construction is particularly interesting for the cases in which the inclusion of additional elements on the part inside the package is not desired. Examples of possible configurations of female openings (5) are shown in FIG. 7.

In regard to orientation, as per this disclosure, the male pins (4) and the female openings (5) are placed with their longitudinal axes in a direction that is essentially parallel to the internal section of the side wall (1). As they are essentially parallel, they are understood to be flat or straight with a slope of up to fifteen degrees. In examples of optional provisions, the male pins (4) and the female openings (5) are placed with their longitudinal axes in a direction that is completely parallel to the internal section of the side wall (1), and between each other.

According to a specific optional feature, the lids included in this disclosure not only have male pins (4) and female openings (5) with specific sizes, they also have specific spatial distributions for those pins and openings when there is more than one. When there are two or more male pins (4) with a diameter of (4.8±0.1) or (6.5±0.1) millimeters, the spatial distribution of those pins optionally matches that of the points of the quadrangular matrix formed by multiple parallel and orthogonal lines with a distance of (8.0±0.1) millimeters between them. When there are two or more male pins (4) with a diameter of (9.4±0.2) millimeters, the spatial distribution from the center of those pins matches that of the points of the quadrangular matrix formed by multiple parallel and orthogonal lines with a distance of (16±0.2) millimeters between them. When there are two or more female openings (5) with an internal diameter of (4.8±0.1) or (6.5±0.1) millimeters, the spatial distribution from the center of those openings matches that of the points of the quadrangular matrix formed by multiple parallel and orthogonal lines with a distance of (8.0±0.1) millimeters between them, optionally containing an additional female opening (5) at the intersection of the diagonal lines of the squares in that matrix. When there are two or more female openings (5) with an internal diameter of (9.4±0.2) millimeters, the spatial distribution from the center of those openings matches that of the points of the quadrangular matrix formed by multiple parallel and orthogonal lines with a distance of (16±0.2) millimeters between them, optionally containing an additional female opening (5) at the intersection of the diagonal lines of the squares in that matrix.

The number and distribution of the male pins (4) and the female openings (5) may be present in various quantities and locations. In certain types of optional constructions, their distribution allows lids, according to this disclosure, to be simultaneously connected to three or more lids in multiple positions and configurations, including the diagonal stacking of lids so that one or more male pins (4) or female openings (5) on the same surface are available for additional connection, even when the lid is already connected to another lid. Therefore, the positioning of two or more connecting elements may be interesting (female openings (5) or male pins (4)) far away from each other and close to the perimeter of the top surface (2) on its outside wall (2-*e*) and/or its inside wall (2-*i*).

Another interesting optional construction is the distribution of male pins (4) and female openings (5) such that when two equal lids are stacked up linearly, they do not form pairs of female openings (5) with connectable male pins (4). That construction may be particularly useful in preventing an undesired connection between two lids, for example, on automatic package-closing lines in which linearly stacked lids are provided, with one lid on top of another.

Figure 8:
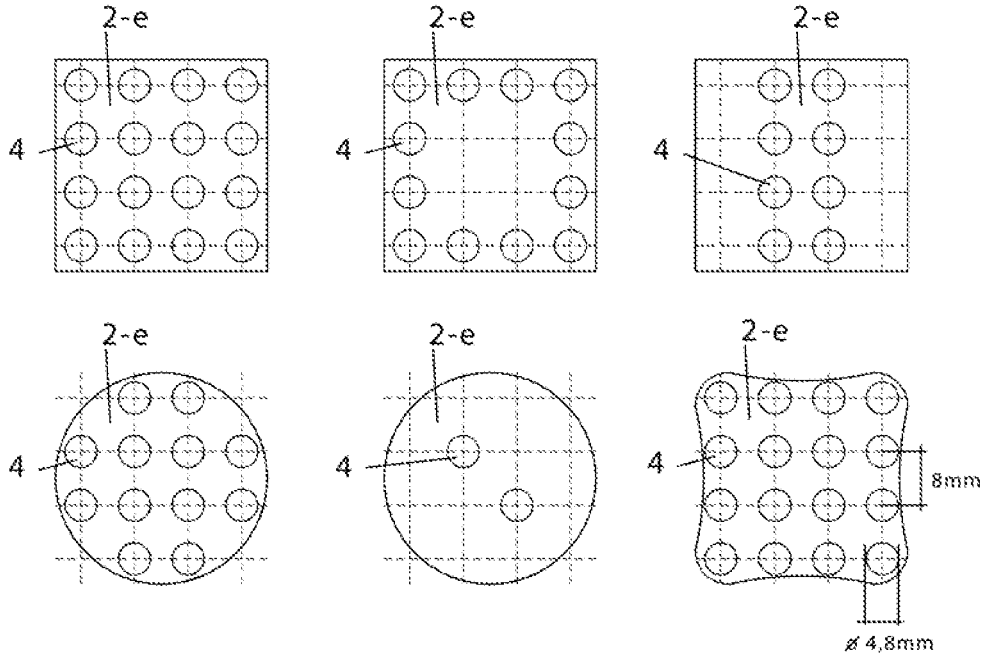
FIGS. 8 and 9 show, respectively, different distributions of optional positioning of male pins (4) with (4.8±0.1) millimeters of external diameter (ED) and female openings (5) with (4.8±0.1) millimeters of internal diameter (ID). The figures in 8 are views from above, and the figures in 9 are views from below. In both FIGS. 8 and 9, the hypothetical dotted lines illustrate a quadrangular matrix formed by multiple parallel lines and right angles with a distance of (8.0±0.1) millimeters between them.
Figure 9:
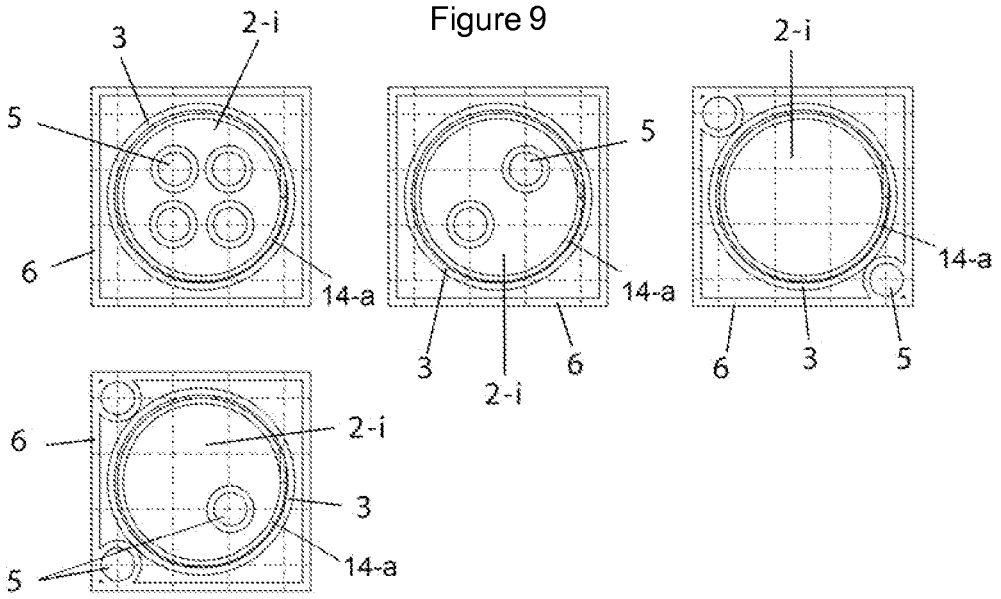

FIGS. 8 and 9 show, respectively, examples of optional ways to distribute the positions of male pins (4) and female openings (5).

According to another specific optional feature, the lids included in this disclosure may show a parallelepiped shape in which the top surface (2) is rectangular, with at least one lateral dimension (L) of (((N×8)−0.2)±0.2) millimeters, in which N is a whole number. Also in that case, there will be an optional male pin (4) or a female opening (5) with a diameter of (4.8±0.1) millimeters with the center positioned a distance of (((n×8)−4.1)±0.1) millimeters from the edge of the top surface, or there will be a male pin (4) or a female opening (5) with a diameter of (9.4±0.2) millimeters with the center positioned at a distance of (((n×16)−8.2)±0.2) millimeters from the edge of the top surface (2), where n is a whole number, independent of N.

According to yet another optional feature, the lids included in this disclosure have a top surface (2) and the base of the lid (3) in the shape of flat parallels, and they are at a height (H) of ((M×3.2)±0.2) millimeters where M is a whole number. FIG. 9 shows examples of height (H) measurements that are optional for the lids.

Figure 10:
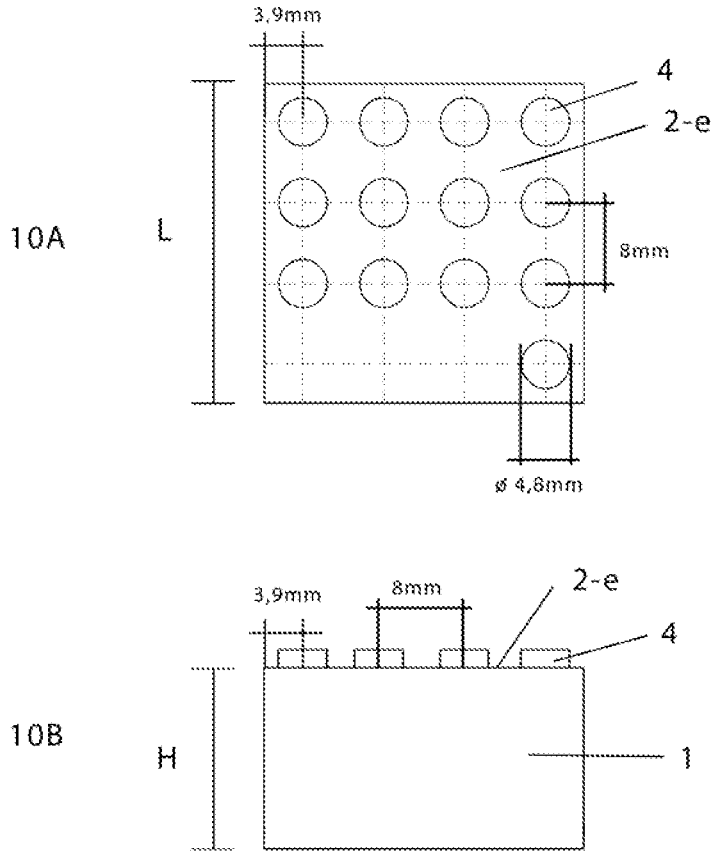
FIG. 10 shows the way in which the optional lateral dimension (L) and the height (H), also optional, may be measured in lids with a parallelepiped shape. It also shows positioning of male pins (4) with diameters of (4.8±0.1) millimeters in relation to the perimeter of the external wall of the upper surface (2-*e*). 10A is a view from above, and 10B is a side view.

FIG. 10 shows examples of lateral (L) dimensions and height (H) of lids with a parallelepiped shape, as well as an example of positioning of male pins (4) with diameters of (4.8±0.1) millimeters.

Figure 11:
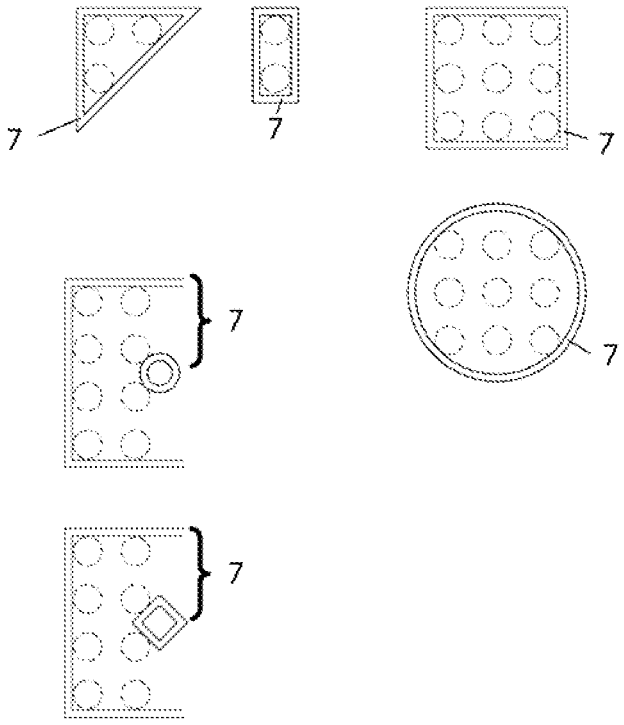
FIG. 11 shows examples of areas for optional connection (7). In all cases, lower views, in which the free space for male pins to be inserted into, are shown by hypothetical dotted lines.

Also in relation to the optional sizes and configurations, the side wall (1) and/or the external skirt (6) or additional elements may delimit spaces that touch sets of two or more male pins (4), forming areas of optional connection (7), such as, for example, triangular areas that touch three male pins (4) or quadrangular or circular areas that touch four or eight male pins (4), or even to parallel planes that touch two different male pins (4). Examples of configurations of those areas of optional connection (7) are shown in FIG. 11.

According to another optional feature, the lids included in this disclosure may be associated with a rupture seal (8) that may or may not be removed from the lid at the time the package is opened. The rupture seal (8) is usually in the shape of a ring connected to the base of the lid (3) by means of small perforated connections, or a thin barrier made of the material of which the lid is made, and those connections or that fine barrier are usually broken when the lid is removed from the package. In the cases in which the base of the lid (3) has small indentations or teeth, the junctions formed by the side wall (1), base of the lid (3) and rupture seal (8) may look like small windows at the level of the base of the lid (3).

In addition to its functional application of locking lids or indicating that a package has been tampered with, the use of removable rupture seals (8) may be particularly interesting, for example, in cases in which the distribution of the male pins (4) and female openings (5) over the external wall of the top surface (2-*e*) and under the internal wall of the top surface (2-*i*) may form connectable pairs of female openings (5) with male pins (4), when two lids that do not have rupture seals (8) are stacked linearly. In these cases, the temporary lengthening of the side wall (1) by the rupture seal (8) may be used to prevent an undesired connection between two lids, for example, in automatic package-closing lines.

Figure 12:
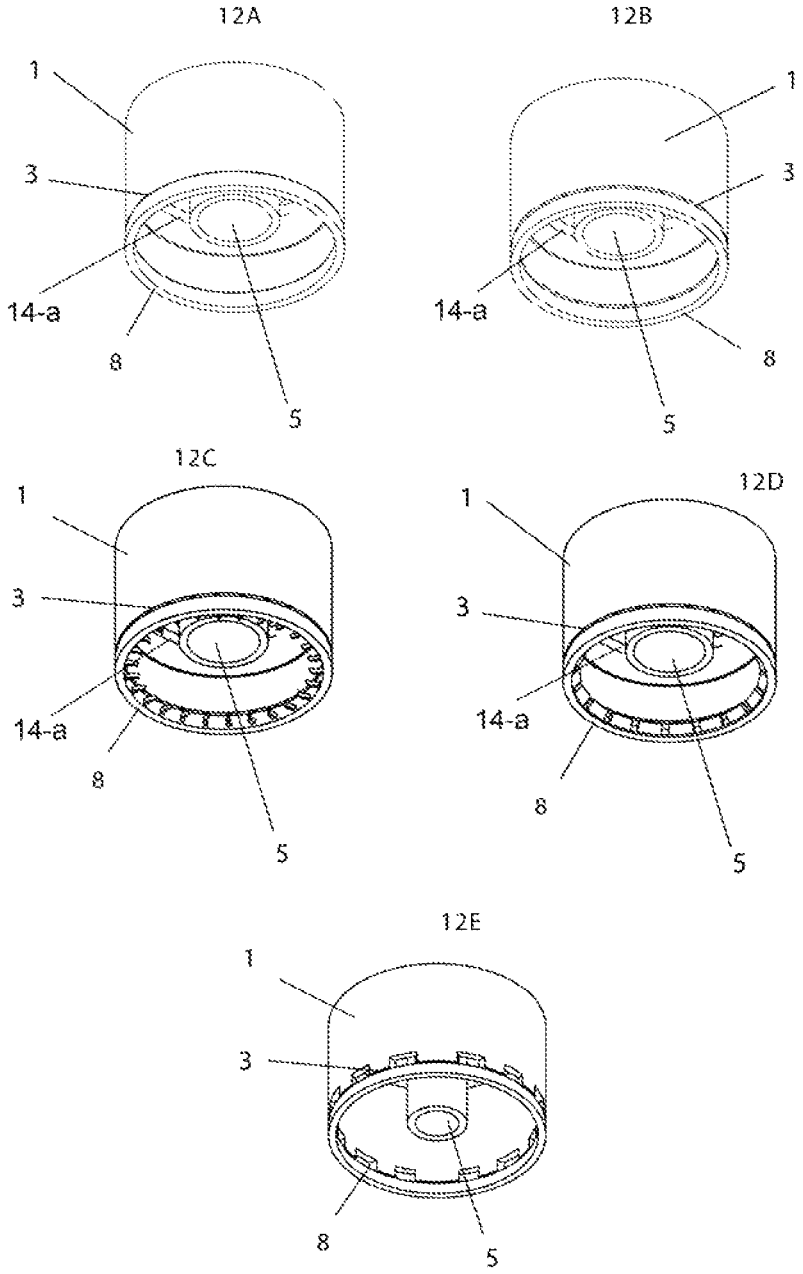
Figure 13A:
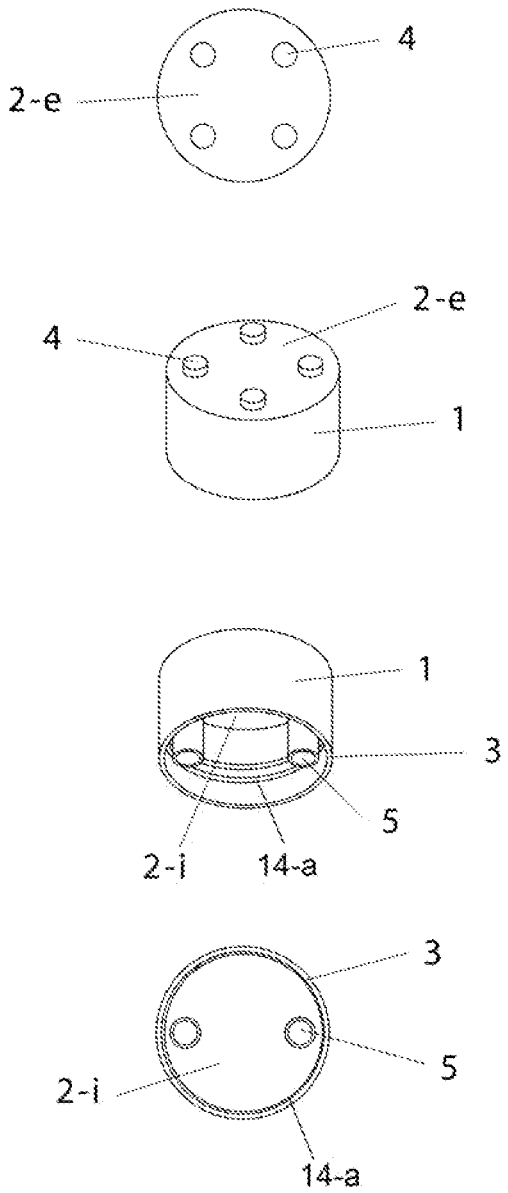
FIG. 13A shows an example in which the positioning of the connecting elements is such that two lids can be connected to each other in a diagonal stack without there being a mismatch between the elements that comprise the lids.
Figure 13B:
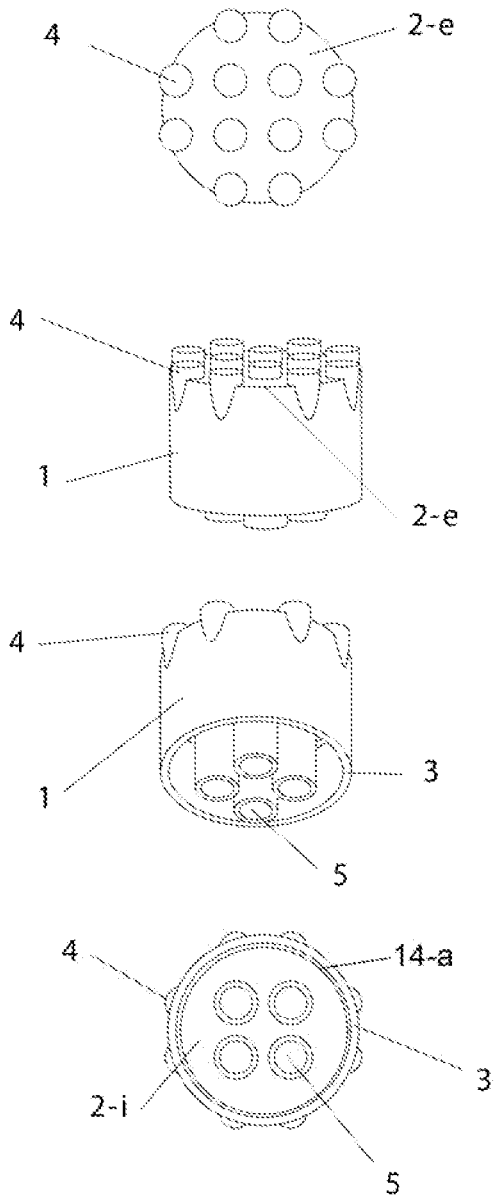
FIG. 13B shows an example of how female openings (5) project beyond the base of the lid (3), so that the base of the lid (3) does not touch male openings [sic] (4) from a second lid to be connected in a diagonal stack, with the first lid.
Figure 13C:
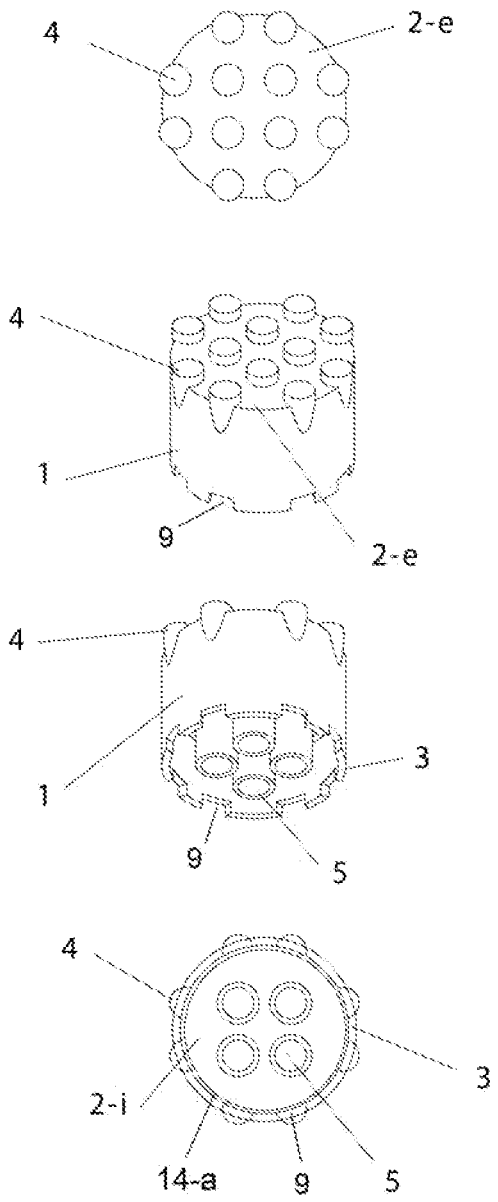
FIG. 13C shows an example of how the base of the lid (3) has small indentations so that it does not touch male openings [sic] (4) from a second lid to be connected in a diagonal stack, with that first lid.
Figure 13D:
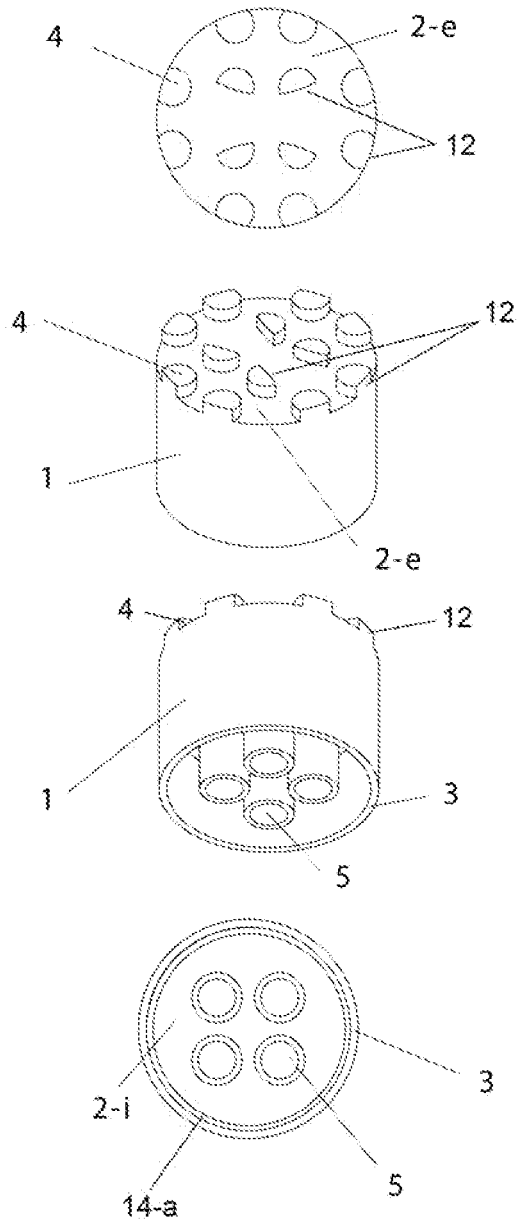
FIG. 13D shows an example of how the male pins (4) have indentations (12) so that they do not touch the base of the lid (3) from a second lid to be connected in a diagonal stack, with the first lid.
Figure 14:
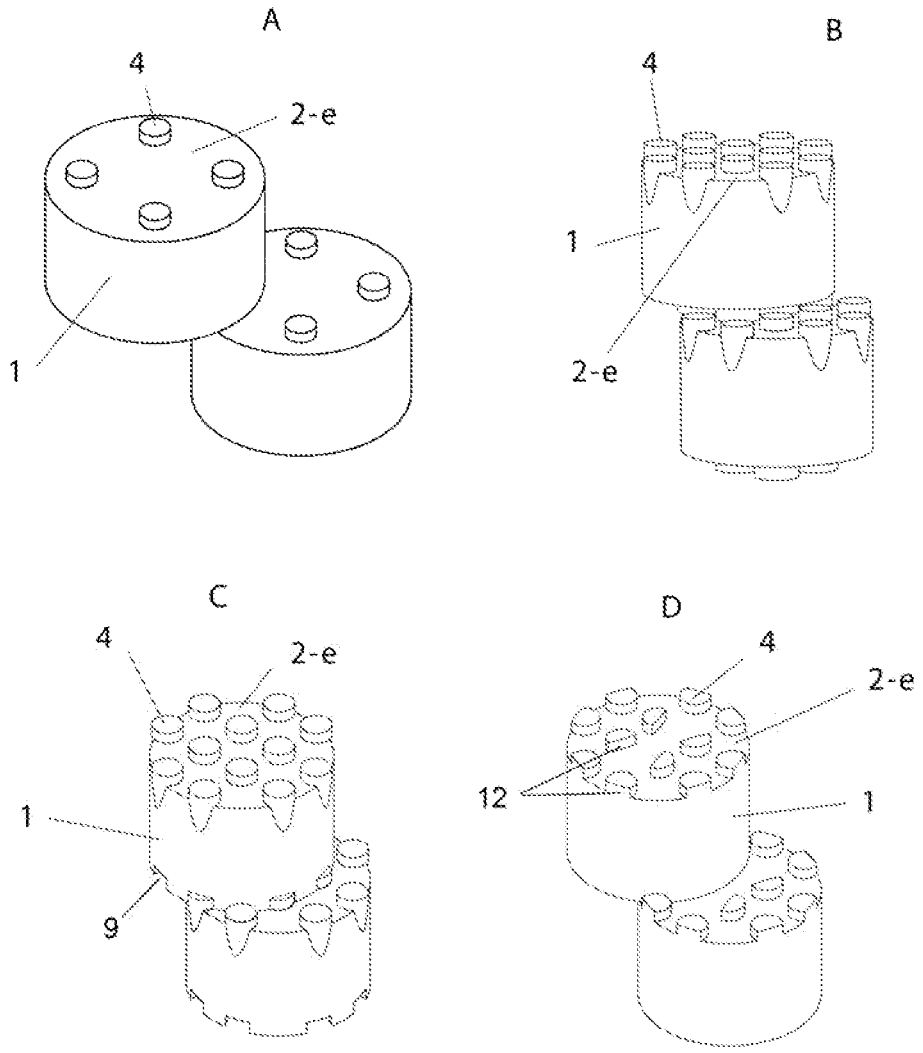
FIG. 14 shows optional ways of assembling lids according to this disclosure.

FIG. 12 shows examples of optional rupture seals (8) for the lids.

Examples of different distributions of positioning and optional configurations of female openings (5), male pins (4) and the base of the lid (3) are shown in FIGS. 13A to 13D. Examples of possible forms of optional assembly of lids as per this disclosure are shown in FIGS. 14A to 14D.

Figure 15:
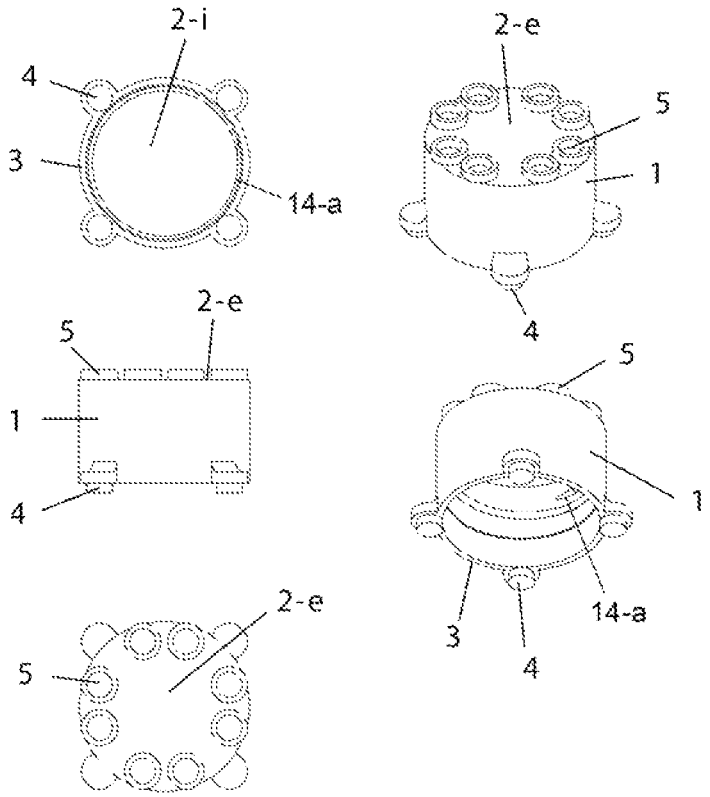
FIG. 15 shows an optional configuration in which the male pins (4) are located on the lower part of the lid and the female openings (5) are located on the external wall of the top surface (2-*e*).

FIG. 15 shows an optional configuration in which the male pins (4) are located on the lower part of the lid and the female openings (5) are located on the external wall of the top surface (2-*e*).

Various other optional features may be used in conjunction with the lids included in this disclosure, including the use of reliefs or stamps on their surfaces that may form mosaics or pre-determined figures, the use of materials with different colors, transparencies and compositions. Optionally, combinations of the lids included in this disclosure may be used with grooves, indentations and other types of connectors, as described in the publications referenced on pages 1 and 2 above.

According to a second main feature, this disclosure includes the use of lids according to this disclosure for assembly of sets of connected lids by connecting tubular female openings (5) or male pins (4) of a first lid, according to this disclosure, respectively with a male pin (4) or a tubular female opening (5) from a second lid, according to this disclosure.

The use of lids as per this disclosure, for the assembly of sets of connected lids, may be used in several types of industries. For example, in the toy industry, in the furniture industry, in the civil construction industry as a thermal insulation structural element, and acoustic insulation, among other applications.

According to a third main feature, this disclosure includes lid-production processes as per this disclosure. Such production processes include molding processes by injection or compression.

As per this disclosure, injection molding is understood to be a manufacturing process that involves melting the raw material (usually in the form of granules or powder) in a chamber, followed by injecting the melted material inside the cavity of a mold, followed by subsequent cooling and extraction of formed pieces. Examples of equipment for injection molding are produced by the company NISSEI PLASTIC INDUSTRIAL CO. LTD. and sold under the name NEX-III Series, such as, for example, the machine NEX80-III-12EG.

According to this disclosure, compression molding is understood to be a manufacturing process that involves the heating and compression of a raw material (usually in the form of granules or powder) directly into the cavity of a mold, followed by extraction of formed pieces. Examples of equipment used for injection molding are produced by GRUPO SACMI and sold under names such as CCM32M, CCM24L, CCM48S, among others.

The invention claimed is:

1. A lid in the form of a building block, comprising:

a side wall having a lid fixing element for securing the lid to a package configured to be closed;

a top surface having an internal wall and an external wall;

a base defining recesses in relation to a height of connecting elements located on a lower section of the lid, the recesses of a shape selected from the group consisting of indentations, inward curves, narrowings, and combinations thereof;

one or more male pins; and one or more female openings, with longitudinal axes placed in a direction that is essentially parallel to an internal section of the side wall, wherein the one or more male pins have an external diameter of 4.8±0.1 millimeters, 6.5±0.1 millimeters, or 9.4±0.2 millimeters, and one or more female openings have an internal diameter of 4.8±0.1 millimeters, 6.5±0.1 millimeters, or 9.4±0.2 millimeters.

2. The lid in accordance with claim 1, wherein when there are two or more male pins with an external diameter of 4.8±0.1 or 6.5±0.1 millimeters, a spatial distribution of the two or more male pins optionally matches points of a quadrangular matrix formed by multiple parallel and orthogonal lines with a distance of 8.0±0.1 millimeters.

3. The lid in accordance with claim 1, wherein when there are two or more male pins with an external diameter of 9.4±0.2 millimeters, a spatial distribution from a center of the two or more male pins matches points of a quadrangular matrix formed by multiple parallel and orthogonal lines with a distance of 16±0.2 millimeters.

4. The lid in accordance with claim 1, wherein when there are two or more female openings with an internal diameter of 4.8±0.1 or 6.5±0.1 millimeters, a spatial distribution from a center of the two or more female openings matches points of a quadrangular matrix formed by multiple parallel and orthogonal lines with a distance of 8.0±0.1 millimeters between each other, optionally containing an additional female opening at an intersection of diagonal lines of squares in the quadrangular matrix.

5. The lid in accordance with claim 1, wherein when there are two or more female openings with an internal diameter of 9.4±0.2 millimeters, a spatial distribution from a center of the two or more female openings matches points of a quadrangular matrix formed by multiple parallel and orthogonal lines with a distance of 16±0.2 millimeters, optionally containing an additional female opening at an intersection of diagonal lines of squares in the quadrangular matrix.

6. The A lid in accordance with claim 1, wherein the lid includes a parallelepiped shape in which the top surface has at least a lateral dimension of (((N×8)−0.2)±0.2) millimeters, wherein N is a whole number.

7. The lid in accordance with claim 1, wherein the top surface and the base of the lid are parallel planes and have a height of ((M×3.2)±0.2) millimeters, wherein M is a whole number.

8. The lid in accordance with claim 1, wherein the one or more male pins includes indentations to provide space for the base of the lid of a second lid, when two lids are connected to each other.

9. The lid in accordance with claim 1, further comprising a rupture seal that prevents an undesired connection between two lids, prior to removal of the rupture seal.

10. A method of assembling sets of connected lids with the lid in accordance with claim 1, the method comprising:

connecting the one or more female openings or the one or more male pins of a first lid, respectively with the one or more male pins or the one or more female openings of a second lid.

11. A process of manufacturing the lid in accordance with claim 1 wherein the manufacturing is by a process selected from the group consisting of injection molding, and compression molding.

12. A lid in the form of a building block, comprising:

a side wall having a lid fixing element for securing the lid to a package configured to be closed;

a top surface having an internal wall and an external wall;

a base defining recesses in relation to a height of connecting elements located on a lower section of the lid, the recesses applied along an entire length of the lid such that the connecting elements are configured to project beyond the base of the lid;

one or more male pins; and one or more female openings, with longitudinal axes placed in a direction that is essentially parallel to an internal section of the side wall, wherein the one or more male pins have an external diameter of about 4.8 millimeters, about 6.5 millimeters, or about 9.4 millimeters, and one or more female openings have an internal diameter of about 4.8 millimeters, about 6.5 millimeters, or about 9.4 millimeters.

13. A lid in the form of a building block, comprising:

a side wall having a lid fixing element for securing the lid to a package configured to be closed;

a top surface having an internal wall and an external wall;

a base defining recesses in relation to a height of connecting elements located on a lower section of the lid, the connecting elements distributed in such a way so that when two equal lids are linearly stacked, they do not form pairs of female openings with connectable male pins;

one or more male pins; and one or more female openings, with longitudinal axes placed in a direction that is essentially parallel to an internal section of the side wall, wherein the one or more male pins have an external diameter of about 4.8 millimeters, about 6.5 millimeters, or about 9.4 millimeters, and one or more female openings have an internal diameter of about 4.8 millimeters, about 6.5 millimeters, or about 9.4 millimeters.

* * * * *